US010890878B2

(12) United States Patent
Denden et al.

(10) Patent No.: US 10,890,878 B2
(45) Date of Patent: Jan. 12, 2021

(54) STRIKE MODE AND TUNE SELECTOR FOR A WATCH OR TIMEPIECE

(71) Applicant: Blancpain SA, Le Brassus (CH)

(72) Inventors: Mehdi Denden, Les Rousses (FR); Julien Peter, Gollion (CH)

(73) Assignee: Blancpain SA, Le Brassas (CH)

( * ) Notice: Subject to any disclaimer, the term of this patent is extended or adjusted under 35 U.S.C. 154(b) by 358 days.

(21) Appl. No.: 16/035,900

(22) Filed: Jul. 16, 2018

(65) Prior Publication Data

US 2019/0033789 A1 Jan. 31, 2019

(30) Foreign Application Priority Data

Jul. 25, 2017 (EP) ..... 17182977

(51) Int. Cl.

| | |
|---|---|
| ***G04B 21/06*** | (2006.01) |
| ***G04B 21/12*** | (2006.01) |
| ***G04B 23/02*** | (2006.01) |
| ***G04B 21/10*** | (2006.01) |
| ***G04B 23/12*** | (2006.01) |

(52) U.S. Cl.

CPC ..... *G04B 21/06* (2013.01); *G04B 21/10* (2013.01); *G04B 21/12* (2013.01); *G04B 23/026* (2013.01); *G04B 23/12* (2013.01)

(58) Field of Classification Search

CPC ..... G04B 21/06; G04B 21/10; G04B 21/12; G04B 23/026; G04B 23/12

See application file for complete search history.

(56) References Cited

U.S. PATENT DOCUMENTS

| | | | | |
|---|---|---|---|---|
| 9,244,433 | B2 * | 1/2016 | Behra | G04B 21/00 |
| 2012/0230162 | A1 | 9/2012 | Goeller | |
| 2012/0230163 | A1 * | 9/2012 | Goeller | G04B 19/23 368/267 |
| 2017/0060095 | A1 | 3/2017 | Behra | |

FOREIGN PATENT DOCUMENTS

| | | |
|---|---|---|
| CH | 706 080 B1 | 8/2013 |
| EP | 1 925 997 A1 | 5/2008 |
| EP | 2 498 146 A1 | 9/2012 |
| EP | 3 136 188 A1 | 3/2017 |

OTHER PUBLICATIONS

European Search Report dated Feb. 16, 2018 in European Application 17182977.3 filed on Jul. 25, 2017 (with English Translation of Categories of Cited Documents).

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A striking mechanism for a watch including an hour snail driven by a movement, a strike wheel set including a detent ratchet and a repeating rack pinion, a pivoting hour-rack for reading the snail and driving the pinion, a click set in motion at each passing strike to drive the detent ratchet, with a mode selector mechanism for selection by the user of a particular strike mode, among distinct modes including a silent mode, defining the angular position of a cam having an external profiled surface, wherein, in silent mode, the largest radius pushes back a beak of a silencing lever, to orient it into a position where its main arm moves the click away from the ratchet in order to disable every passing strike function.

16 Claims, 17 Drawing Sheets

STRIKE MODE AND TUNE SELECTOR FOR A WATCH OR TIMEPIECE

This application claims priority from European Patent Application No. 17182977.3 filed on Jul. 25, 2017, the entire disclosure of which is hereby incorporated herein by reference.

FIELD OF THE INVENTION

The invention concerns a striking mechanism for a watch or timepiece including a movement, said striking mechanism being capable of operation in at least two distinct passing strike modes, and with at least two distinct tunes and/or on at least two distinct sets of gongs.

The invention further concerns a watch comprising a movement including an output for releasing a passing strike by the movement, this movement being arranged to drive at least one reference wheel set, and this watch includes at least one such striking mechanism.

The invention also concerns a timepiece comprising a movement including an output for releasing the passing strike function by the movement, this movement being arranged to drive at least one reference wheel set, and the timepiece includes at least one such striking mechanism.

The invention concerns the field of striking mechanisms for watches, timepieces or music boxes.

BACKGROUND OF THE INVENTION

Timepiece striking mechanisms are large complications, which are complex as regards not only the number and complexity of the kinematics of their components, but also their possible operating modes. Choosing between the various strike modes is in itself an additional complication, which employs expensive components, such as column wheels or the like, and which takes up significant space inside the watch or timepiece case, which often has a set of notches for this selection function. The interface between the selection mechanism and the exterior of the case must also enjoy a particular seal tightness. Managing safety features between the various modes is always complex.

These mechanisms become still more complicated for the selection of an even higher number of distinct modes, in particular when a distinction has to be made between the set of different tunes, for example in order to differentiate between the quarters struck, or the different gongs played, as in European Patent Application No. EP2947523B1 by the same Applicant, when incorporating an alarm mechanism according to European Patent Application EP15190808.4 by the same Applicant, a safety mechanism for selection and/or release of a strike or tune according to European Patent Application No. EP15168700.1 by the same Applicant, a tune selection mechanism with an uncouplable lifting piece according to European Patent Application No. EP3136188A1 by the same Applicant, or a carillon striking mechanism according to European Patent Application No EP16206572.6 by the same Applicant.

Swiss Patent No. CH706080B1 in the name of PATEK PHILIPPE discloses a timepiece including a case enclosing a mechanical timepiece movement that includes a repeater striking mechanism able to be released automatically by the mechanical timepiece movement, wherein the striking mechanism includes a release lever provided with a click pivotably mounted on said release lever and arranged to mesh with the toothing of a detent ratchet comprised in the fusee of the striking mechanism, such that, on automatic release, a nut driven by the motion work of the movement, preferably integral with the cannon pinion of the timepiece movement, causes the release lever to pivot towards the detent ratchet, and so that, when the release lever drops, the click beak drives the detent ratchet in rotation; the striking mechanism includes a strike mode selection mechanism. This strike mode selection mechanism includes an operating member that is accessible from outside the timepiece and formed of a slide-piece, mounted to slide in a back-and-forth movement on the periphery of the timepiece case between at least two positions, one corresponding to a strike mode and the other to the silent mode.

European Patent Application No. 1925997A1 in the name of CHRISTOPHE CLARET discloses a striking mechanism including an energy source for driving the racks and a gear train connecting the energy source to a regulating member, the racks being kinematically connected to the energy source by means of a strike drive device arranged inside the train and actuated by a control member, said racks being intended to cooperate with snails to obtain information about the current time, wherein the control member is a cam shaft provided with at least one cam cooperating with the drive device via at least one connecting element and at least one drive wheel set for pivoting said cam when the striking mechanism is released.

European Patent Application No. EP 2498146A1 in the name of MONTRES BREGUET discloses a mechanism for releasing an acoustic signal, called a secondary striking mechanism, for a timepiece, which includes at least one timepiece movement, and on the one hand, at least one secondary strike control mechanism arranged to release a secondary striking mechanism at a particular instant related to a presetting, and/or to the reception of a signal, and/or to the crossing of a threshold value for a physical parameter, and on the other hand, at least one striking or grande sonnerie or minute repeater mechanism controlled by main strike control means arranged to release a main striking mechanism at instants programmed by said timepiece movement, or on demand. This secondary strike release mechanism includes a coupling mechanism arranged, at said particular instant for releasing said secondary strike control mechanism, to prevent a main strike function being performed by uncoupling said main strike control means, and to release a secondary strike signal by coupling at least one part of said striking or grande sonnerie or minuter repeater mechanism, and further arranged, outside said particular instant for releasing said secondary strike control mechanism and after the performance of said secondary strike function linked to said particular instant for releasing said secondary strike control mechanism, to allow a main striking mechanism mechanism to operate by coupling said main strike control means, and to release a main striking mechanism by coupling said striking or grande sonnerie or minuter repeater mechanism.

SUMMARY OF THE INVENTION

The invention proposes to achieve the selection of strike modes and of tunes and/or of sets of gongs employed for the striking functions, in a simple and reliable manner, compatible with the implementation of efficient safety means of average complexity.

To this end, the invention concerns a striking mechanism according to claim 1.

The invention further concerns a watch comprising a movement including an output for releasing a passing strike by the movement, this movement being arranged to drive at least one reference wheel set, and the watch includes at least one such striking mechanism.

The invention also concerns a timepiece comprising a movement including an output for releasing the passing strike function by the movement, this movement being arranged to drive at least one reference wheel set, and the timepiece includes at least one such striking mechanism.

BRIEF DESCRIPTION OF THE DRAWINGS

Other features and advantages of the invention will appear upon reading the following detailed description, with reference to the annexed drawings, in which:

FIGS. 1 and 2 represent the striking mechanism according to the invention in petite sonnerie mode.

FIGS. 3 and 4 represent the striking mechanism according to the invention in grande sonnerie mode.

FIGS. 5 and 6 represent the striking mechanism according to the invention in silent mode.

FIGS. 7 and 8 represent the striking mechanism according to the invention stopped in grande sonnerie mode.

FIGS. 13 and 14 represent the striking mechanism according to the invention in petite sonnerie mode with the first tune.

FIGS. 15 and 16 represent the striking mechanism according to the invention in grande sonnerie mode with the second tune.

FIGS. 17 and 18 represent the striking mechanism according to the invention in silent mode, where it is possible to play the second tune by means of the minute repeater control device.

FIGS. 20 and 21 represent the striking mechanism according to the invention in petite sonnerie mode with the first tune.

FIGS. 22 and 23 represent the striking mechanism according to the invention in petite sonnerie mode with the second tune.

FIGS. 24 and 25 represent the striking mechanism according to the invention in grande sonnerie mode with the first tune.

FIGS. 26 and 27 represent the striking mechanism according to the invention in grande sonnerie mode with the second tune.

FIGS. 28 and 29 represent the striking mechanism according to the invention in silent mode, where it is possible to play the first tune by means of the minute repeater control device.

DETAILED DESCRIPTION OF PREFERRED EMBODIMENTS

Figure 2:
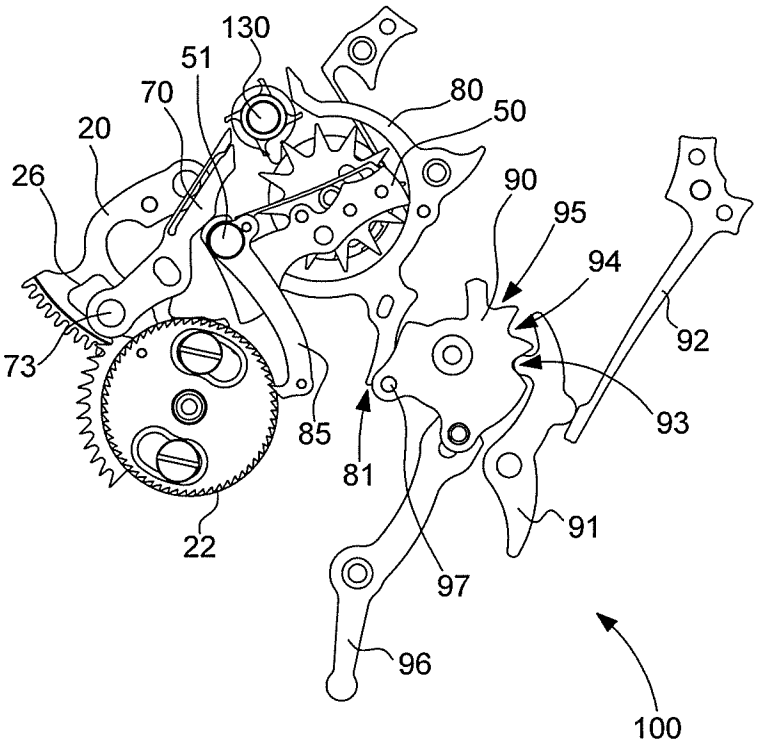
FIGS. 1 to 8 schematically represent, two-by-two and in a plan view, the striking mechanism according to the invention in the same position, the odd Figures showing the back side, and the even Figures showing the front side; not all the components are represented, only those which are essential for performing the illustrated function are visible.

The invention concerns a watch 1000 or a timepiece 2000 including at least one specific striking mechanism 100. This timepiece 2000 may be a music box or include a music box.

The work by Francois LECOULTRE entitled *Les montres compliquées* (A Guide to Complicated Watches), Editions Horlogères, Bienne (Switzerland), 1985, ISBN 2-88175-000-1, explains, in detail, the basic mechanisms forming striking mechanisms, at pages 97 to 205 (pages 85 to 181 of the English edition), in different chapters:

repeating watches,
old repeating watches,
modern quarter-repeater,
simplified repeater,
half-quarter repeater,
Breguet half-quarter repeater,
five minute-repeater,
minute-repeaters
clock watches Unless necessary, these basic mechanisms will not be discussed here in detail, since striking mechanism specialists will know how to find the composition of such mechanisms in this universal reference work, in particular in the aforementioned last two chapters.

Striking mechanism 100 according to the invention includes, in a conventional manner, at least one reference wheel set 1, and preferably a plurality of reference wheel sets 1, including time reference snails and/or stars, and particularly a minute snail, a quarter snail and an hour snail 190.

This striking mechanism 100 also includes at least one strike drive wheel set 2, as explained in particular in the chapter on 'Clock Watches' in 'A Guide to Complicated Watches' and visible, in particular, in FIG. 40 of this book. This strike drive wheel set 2 conventionally includes a detent ratchet 22 and a repeating rack pinion 24.

Striking mechanism 100 is capable of operation in at least two distinct passing strike modes, and with at least two distinct tunes and/or on at least two distinct sets of gongs.

This striking mechanism 100 includes a mode selector mechanism 9, which is combined with a tune and/or gong selector mechanism. Mode selector mechanism 9 includes, more particularly, a user-accessible mode selector 96 allowing the user to choose which strike mode to use, and at least one means for selecting a tune or set of gongs controlled by movement 200 for a passing strike, and/or accessible to the user for selecting a tune and/or a set of gongs, for performing passing strike functions or for the minute repeater function when striking mechanism 100 includes a minute repeater mechanism.

More particularly, striking mechanism 100 includes at least one means for selecting a tune or set of gongs 103, 104, which is distinct from mode selector 96.

Striking mechanism 100 cooperates with a movement 200, which drives the reference wheel set(s) 1 and has a specific output 3 illustrated in the Figures, in the non-limiting form of a star 130 for releasing the striking mechanism by the movement, fitted onto a cannon-pinion, and including four teeth, in order to lift, at each quarter hour, an intermediate lever for release by the movement, referred to hereinafter as main lever 70.

Striking mechanism 100 includes at least one pivoting part, which is arranged to cooperate indirectly, via this main lever 70, with the output 3 of movement 200, and particularly includes a feeler arm for reading such a reference wheel set 1 and a rack for driving repeating rack pinion 24. One of these pivoting parts is an hour-rack 20 arranged to cooperate with the hour snail 190. Striking mechanism 100 further includes a main click 85, which is arranged to be set in motion upon each passing strike, and to drive, when possible, detent ratchet 22.

Striking mechanism 100 according to the invention includes all or part of the main strike modes: grande sonnerie, petite sonnerie, alarm, silent, and more particularly includes a minute repeater mechanism, particularly a minute repeater mechanism, notably as explained in the 'Minute Repeater' chapter of 'A Guide to complicated watches'.

The non-limiting variant illustrated by the Figures includes three strike modes: grande sonnerie (GS), petite sonnerie (PS), silent (S), and a minute repeater. This minute repeater mechanism includes, in particular, an hour-rack 20, arranged to cooperate via a feeler arm 29 comprised therein, with an hour-snail 190.

More particularly, striking mechanism 100 includes a mode selector mechanism 9. This mode selector mechanism 9 comprises a user-accessible mode selector 96 which allows the user to choose which strike mode to use, and which controls the angular position of at least one cam 90.

In a variant, the striking mechanism 100 for a watch 1000 includes an hour snail 190 driven by a movement 200, a strike wheel set 2 including a detent ratchet 22 and a repeating rack pinion 24, a pivoting hour-rack 20 for reading the snail 19 and driving the pinion 24, a click 85 set in motion at each passing strike to drive the detent ratchet 22, with a mode selector mechanism 9 for selection by the user of a particular strike mode, among distinct modes including a silent mode, defining the angular position of a cam 90 having an external profiled surface 98. And in silent mode, the largest radius 98S pushes back a beak 61 of a silencing lever 60, to orient it into a position where its main arm 64 moves the click 85 away from the ratchet 22 in order to disable every passing strike function.

In a variant, mode selector mechanism 9 includes at least one cam 90, which may have as many specific positions as there are designated modes of the striking mechanism, as in the variant illustrated by the Figures, or which includes positions specific to only some of these modes. The illustrated variant represents a flat cam 90, which includes three notched portions each corresponding to one of the selectable modes: 93 petite sonnerie, 94 grande sonnerie, 95 silence. More particularly, the notched portions are notches of variable size, requiring increasing force in one of the two directions of operation. More particularly, one particular notch, for example a central notch, is larger than the end notches, to ensure safety by preventing the user from inadvertently changing from one strike mode to another.

Figure 5:
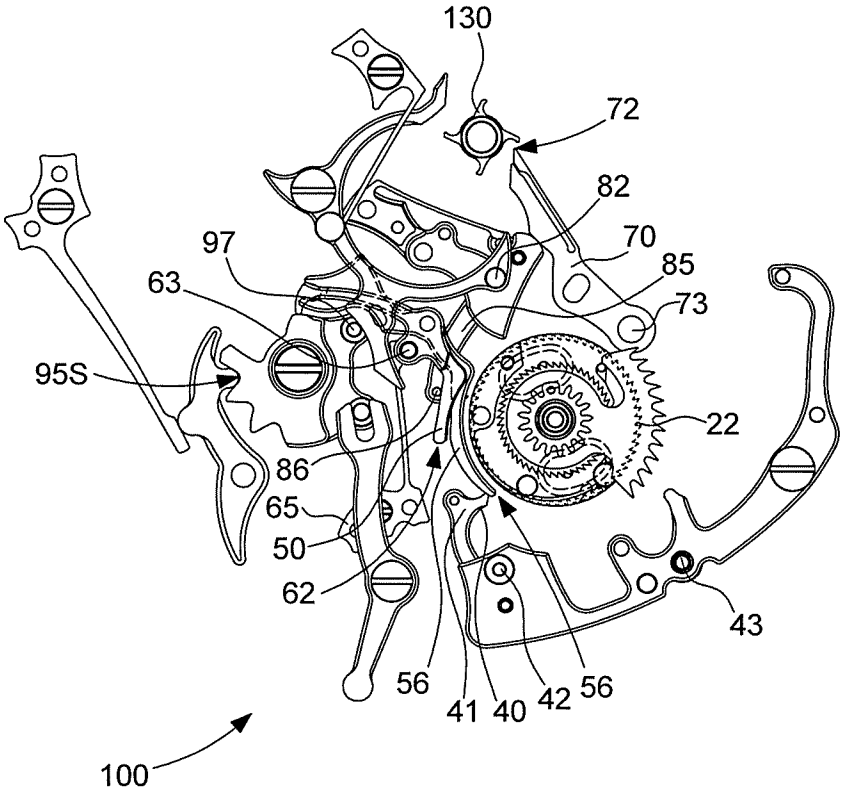

Cam 90 occupies particular positions for the different modes. This cam 90 has a continuous, external, feeler arm support profiled surface 98, which is arranged to cooperate with a beak 61 comprised in a silencing lever 60. This external profiled surface 98 includes an area of larger radius 98S corresponding to silent mode, which is arranged to orient silencing lever 60 into a position where a main arm 64 of silencing lever 60 moves main click 85 away from detent ratchet 22, in order to disable every passing strike in silent mode, as seen in FIG. 5.

It is understood that the invention is suitable for the selection of an even higher number of distinct modes, in particular when a distinction has to be made between the set of different tunes, for example in order to differentiate between the quarters struck, or the set of different gongs, as in EP Patent No. EP2947523B1 by the same Applicant, or when incorporating an alarm mechanism according to European Patent Application No. EP15190808.4 by the same Applicant, a safety mechanism for the selection and/or release of a striking mechanism or tune according to European Patent Application No. EP15168700.1 by the same Applicant. a tune selection mechanism with an uncouplable lifting piece according to European Patent Application No. EP15183110.4 by the same Applicant, or a carillon striking mechanism according to European Patent Application No EP16206572.6 by the same Applicant.

Cam 90 can thus include multiple notches: GS tune A, GS tune B, PS tune A, PS tune B, S, and/or also: GS gong A, GS gong B, PS gong A, PS gong B, S. When there are too many different modes for a single cam, mode selector mechanism 9 can include a plurality of cams 90, especially superposed cams, each relating to certain of these modes, for example with a particular tune, or a particular gong, or otherwise.

Such an arrangement makes it possible, in particular, to distinguish between the strike modes by the tunes played and/or by the gongs used. For example, grande sonnerie mode corresponds to a first tune and/or a first set of gongs, and petite sonnerie mode corresponds to a second tune and/or a second set of gongs.

It is understood that different cams 90 can be superposed, especially coaxially, or juxtaposed in one plane, and especially arranged in series.

In addition to mode selection, intended to ensure that only one mode selected by the user is performed by striking mechanism 100, mode selector mechanism 9 disables the striking mechanism in silent mode by moving the clicks away from strike drive wheel set 2, and prevents access by the hour-rack to the corresponding snail.

In particular, striking mechanism 100 includes a minute repeater with a minute repeater control device 4 including a repeater click 40, which is arranged to drive detent ratchet 22 once said hour-rack 20 has performed a reading on hour-snail 190. And, in silent mode, the main arm 64 of silencing lever 60 allows repeater click 40 access to detent ratchet 22, provided the energy available is sufficient to complete a striking function.

In a particular embodiment, striking mechanism 100 includes a grande sonnerie mode for the passing strike of each hour and of each quarter hour, repeating the hour at the quarter hour, and a petite sonnerie mode for the passing strike of each hour and of each quarter hour without repeating the hour at the quarter hour. Striking mechanism 100 thus includes a petite sonnerie lever 80, which is arranged to cooperate by bearing on a cam pin 97 comprised in cam 90 of selector mechanism 9, in order, when the petite sonnerie mode is selected, to orient petite sonnerie lever 80 into a position in which the latter prevents hour-rack 20 from moving towards hour snail 190, to prevent the hour being struck at the quarter hours.

When, in this same arrangement, the grande sonnerie mode is selected, cam pin 97 orients petite sonnerie lever 80 into another position in which the latter allows hour-rack 20 to move towards hour-snail 190, to allow the hours to be struck automatically on the quarter hours.

To distinguish between the passing strike of the hours and the quarter hours, striking mechanism 100 advantageously comprises, coaxial to a four-tooth star 130 driven by output 3 and which is arranged to automatically release strikes on the quarter hours, a tear-shaped hour cam 131, comprising a tip 132 which is arranged to lift petite sonnerie lever 80 and to allow hour-rack 20 to move towards hour-snail 190.

The operation of mode selector mechanism 9 does not hinder operation of the minute repeater, and especially in silent mode, except when, advantageously, striking mechanism 100 includes a particular stopping function arranged to prevent any striking function being performed if the amount of energy available is insufficient to ensure that the striking function is completed: striking mechanism 100 then advantageously comprises a stopping mechanism 5, which is arranged to prevent any striking function being performed, in order to avoid the risk presented by certain wheel sets stopping in intermediate positions, which could cause collisions on restarting. It is only when the stopping function is activated that operation of the minute repeater is also prohibited.

This stopping mechanism 5 is arranged to pivot a strike reversing lever 59 when the available energy is insufficient to complete a striking function. This strike reversing lever 59 controls the pivoting of a strike uncoupling lever 55, which is arranged to prevent access by repeater click 40 to detent ratchet 22 when the available energy is insufficient to complete a striking function, and to move main click 85 away from detent ratchet 22 when the available energy is insufficient to complete a striking function.

Mode selector mechanism 9 is preferably designed to avoid the use of a notch system on the watch case, which is standard in the prior art: to this end, a mode selector lever 96 advantageously controls, particularly via an articulated connection as seen in the Figures, the pivoting of cam 90, or cams 90 when there are more than one. More particularly, a cam jumper 91, associated with a cam jumper spring 92 for holding it in position, includes a selector finger 99, which cooperates with one of the notches of cam 90. This jumper 91 and its spring 92 have a dual function: allowing the user to feel the change of notch, and providing certainty of completion of the selection manoeuvre, with return to a clear position corresponding to one of the modes, and never to an intermediate position. Advantageously, spring 92 is oversized to ensure safety, and especially to overcome the friction forces of the gasket in the watch case.

This cam 90 also includes a cam pin 97, which is arranged to form a stop for a petite sonnerie lever 80, whose function will be explained hereinafter. In addition to the mode selection notches, cam 90 advantageously comprises a continuous external profiled surface 98 including at least two feeler arm support areas, arranged to cooperate with a beak 61 of a silencing lever 60: an area of larger radius 98S corresponding to silent mode, and an area of smaller radius 98AGS corresponding to a stoppage in grande sonnerie mode, when the stopping function and the grande sonnerie mode exist.

Mode selection mechanism 9 can be used for different striking mechanisms. Its interactions with the conventional components of a striking mechanism 100 including a minute repeater mechanism are illustrated in a particular arrangement which is detailed below, those skilled in the art who specialise in striking mechanisms for mechanical watches or timepieces, will know how to transpose them to any mechanisms presenting variants.

This striking mechanism 100 is first displayed without the stopping mechanism.

Figure 1:
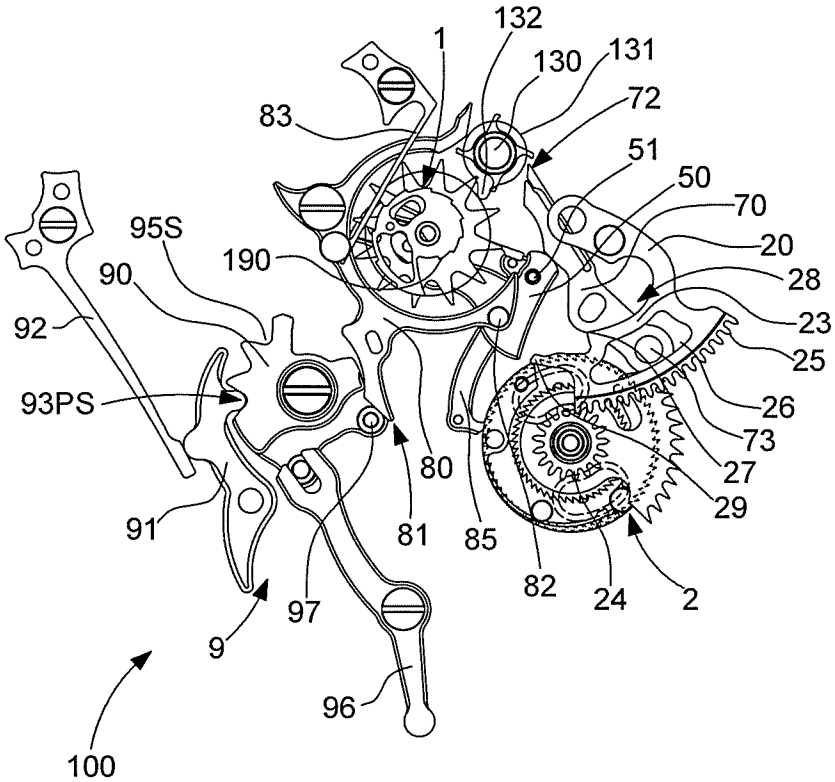

FIGS. 1 and 2 show the mode selector mechanism 9 in the indexing position corresponding to petite sonnerie notch 93PS, which strikes the full hours on passing, and the quarter hours only on passing. The usual quarter-rack and quarter-snail are not represented, in order to simplify the explanation of operation.

Star-wheel 130, arranged in proximity to reference wheel sets 1, is arranged to move into cooperation, every quarter hour, with a beak 72, especially an elastic beak, comprised in strike release main lever 70.

This quarter-rack 20 includes a feeler arm 29 arranged to feel an hour-snail 190, and a rack 25 arranged to cooperate with a repeating rack pinion 24 comprised in a strike drive wheel set 2. Hour-rack 20 further includes, set back with respect to feeler arm 29, a rib 23 which ends, on the same side as feeler arm 29, in a flat abutment portion 27.

Strike drive wheel set 2 includes, in a conventional manner, a detent ratchet 22, which is arranged to cooperate, either with a main strike click 85, or a minute repeater release click 40, provided with a pin 41, and comprised in a minute repeater control device 4, wherein this latter click 40 cooperates with a spring 43.

The pivoting of strike release main lever 70 causes the pivoting of a lever 50 for release by the movement, which carries a thrust spring 52, which rests on main strike click 85, which is also carried by release lever 50.

A conventional petite sonnerie lever 80 carries a banking pin 82. This petite sonnerie lever 80, which is returned by an uncoupling spring 83 fixed to a plate, includes an uncoupling beak 81, which is arranged to rest on a cam pin 97 comprised in cam 90.

Petite sonnerie lever 80 faces hour-rack 20 during the angular travel of the latter, and banking pin 82 is at the level of rib 23 of hour-rack 20, on the same radius, which allows it to cooperate in abutment with flat portion 27 of hour-rack 20, and to immobilise the latter by preventing it from reaching hour-snail 190, so that the hour strike is not repeated on each quarter hour, in accordance with the operation specific to the petite sonnerie mode.

In order to ensure that the hour is struck on the full hour, star-wheel 130 is integral with a tear-shaped hour cam 131, whose tip 132 is arranged to lift petite sonnerie lever 80, and thus its banking pin 82, to allow feeler arm 29 of hour-rack 20 to pass in order to read hour-snail 190.

Figure 4:
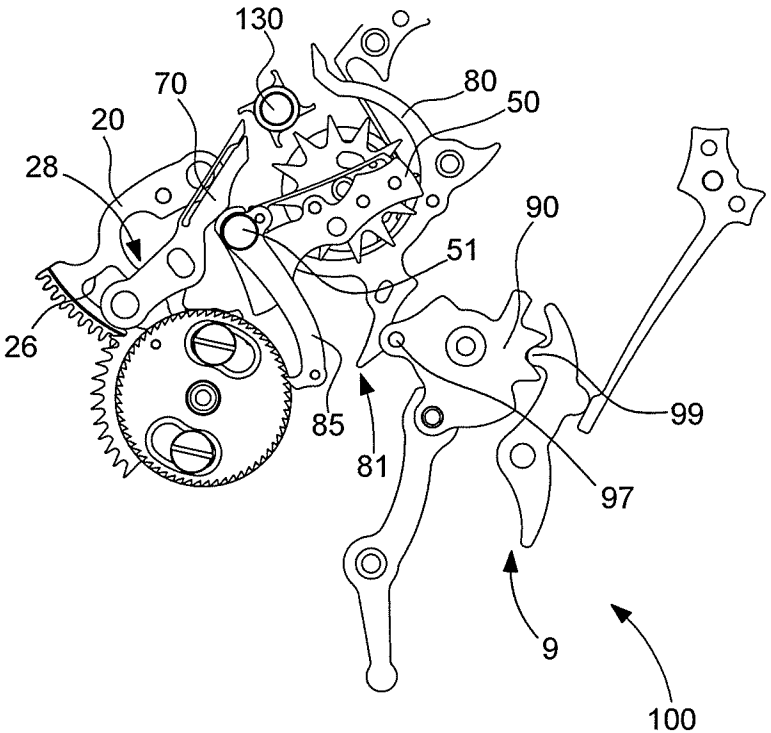
Figure 3:
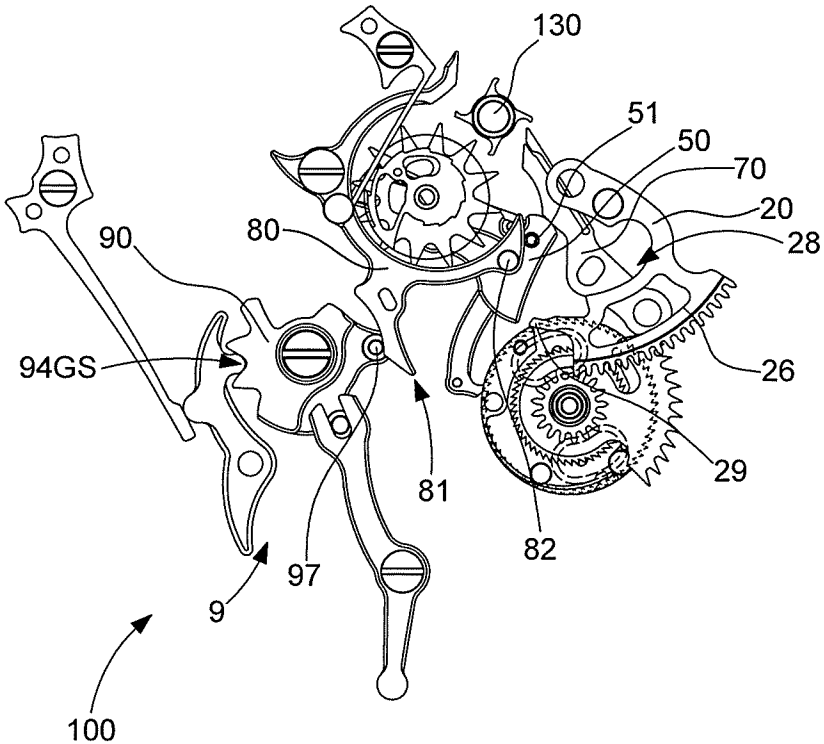

FIGS. 3 and 4 show mode selector mechanism 9 in the indexing position corresponding to grande sonnerie notch 94 GS, which strikes the full hours on passing, and repeats the hour and strikes the quarter-hours on passing. The usual quarter-rack and quarter-snail are not represented. Cam pin 97 bears on petite sonnerie lever 80 at a greater distance from the end of uncoupling beak 81 than in the case of the petite sonnerie, and consequently banking pin 82 is no longer at the level of rib 23, or of flat portion 27 of hour-rack 20, but is at the level of recess 28, which allows hour-rack 20 to pivot freely towards hour-snail 190 at every quarter hour.

For operation in silent mode, striking mechanism 100 includes a grande sonnerie and petite sonnerie isolator, referred to hereinafter as silencing lever 60, which includes, at a first end, a reading beak 61 arranged to cooperate with one of the peripheral areas 98 of mode selector cam 90, and at a second end 62, a main arm 64, which is arranged to stop a main click pin 86, comprised in main strike click 85. This silencing lever 60 includes, in its median part in proximity to its pivot, a silencing pin 63.

Spring 65 constrains silencing lever 60 via pin 63, so that the lever is always in contact with cam 90 via its beak 61. When the selected mode is silent mode, this silencing lever 60 pivots and its part 62 moves to disconnect click 85 from ratchet 22. Cam pin 97 is in contact with uncoupling beak 81 of petite sonnerie lever 80. During a minute repeater function (in petite sonnerie mode), a lever (not represented in the Figures) forms the link between control device 4 and the hole in lever 80, so that hour-rack 20 can fall onto hour-snail 190 of component 1.

Silencing lever 60 is seen in FIGS. 5 to 11, which also include a stopping mechanism 5, which essentially comprises a strike uncoupling lever 55. Striking mechanism 100 thus includes silencing lever 60 and strike uncoupling lever 55, which are partially superposed, and each arranged to hinder access by a specific click to ratchet 22 of strike drive wheel set 2. Indeed, strike uncoupling lever 55 includes a stop arm 56, which is arranged to stop a repeater click pin 41, comprised in a minute repeater release click 40, of minute repeater control device 4.

Figure 6:
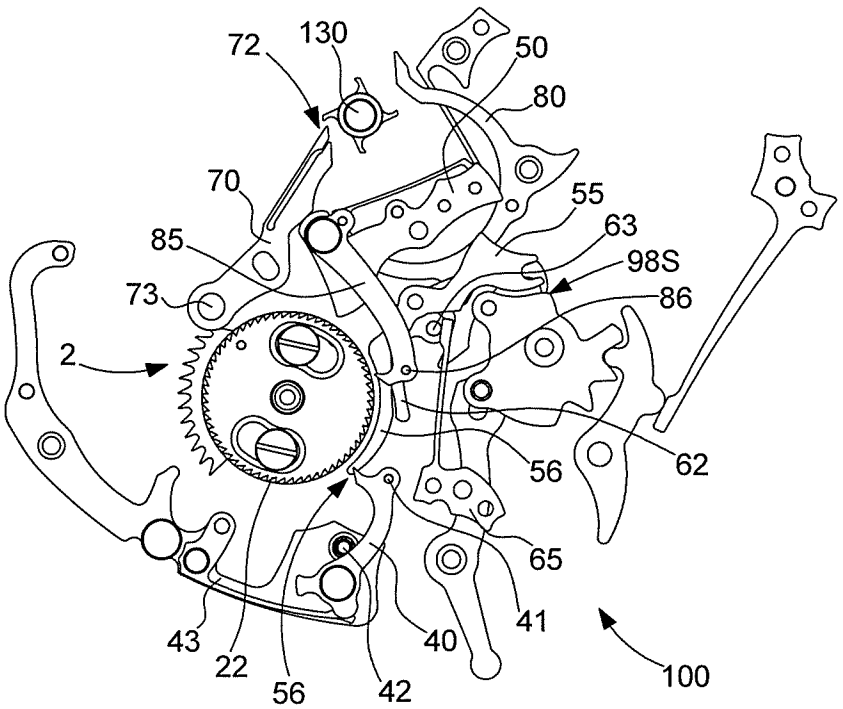

FIGS. 5 and 6 show mode selector 9 in the indexing position corresponding to silent mode notch 95S, wherein the petite sonnerie and grande sonnerie mechanisms are uncoupled, but wherein it is possible to operate the minute repeater. Reading beak 61 of silencing lever 60 is resting on the largest radius 98S of peripheral shoulder 98 of cam 90, and consequently, on the one hand, petite sonnerie lever 80 is stopped by cam pin 97 via spring 67 and, on the other hand, the main arm 64 of silencing lever 60 is in its furthest position from strike drive wheel set 2, and stops main click pin 86. Conversely, strike uncoupling lever 55 is very close to strike drive wheel set 2, since there is nothing to oppose this extreme position, and consequently the minute repeater release click 40 is not hindered and can access detent ratchet 22, and the minute repeater can thus be activated at will by the user.

Figure 8:
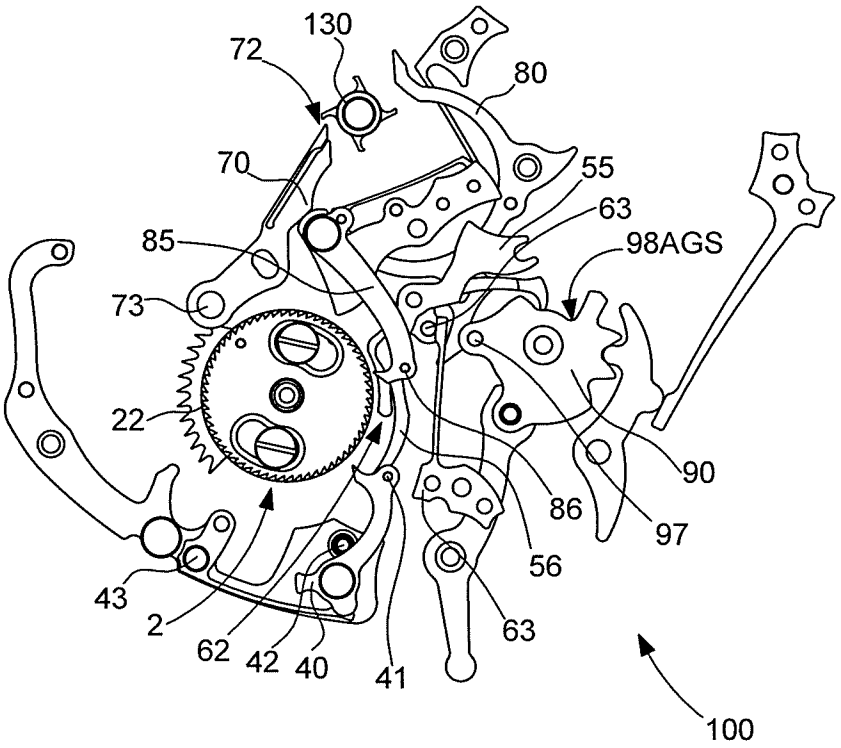
Figure 7:
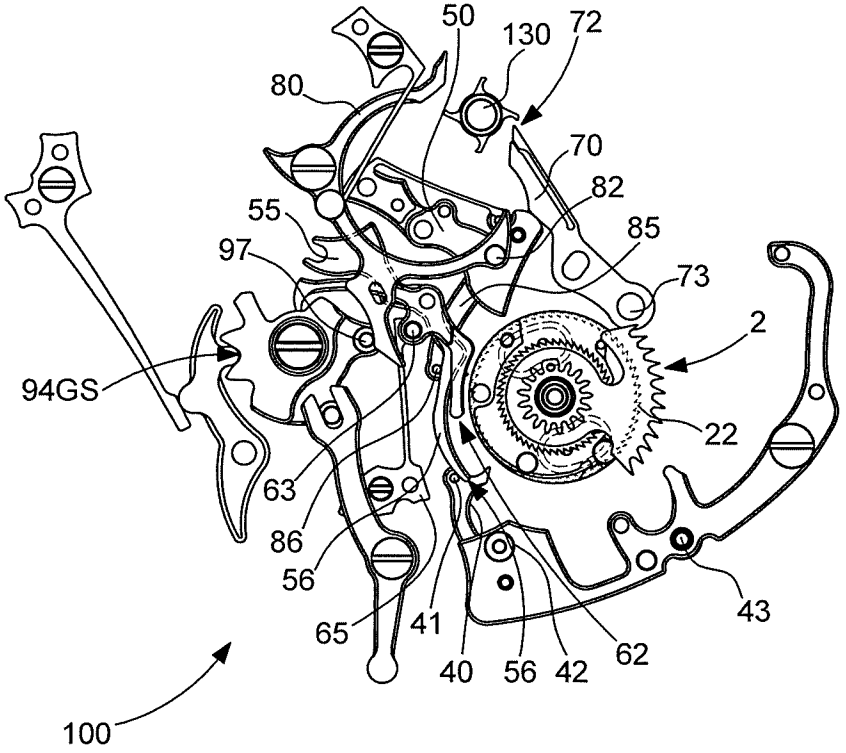

FIGS. 7 and 8 illustrate a stoppage in grande sonnerie mode and show mode selector 9 in the indexing position corresponding to grande sonnerie notch 94GS. Stopping mechanism 5 is arranged to uncouple all the clicks, when the amount of available energy, in the barrel(s) or suchlike, is insufficient. This time, reading beak 61 of silencing lever 60 is resting on the smallest radius 98AGS of peripheral shoulder 98 of cam 90, and, at its second end 62, main arm 64 of silencing lever 60 is in its closest position to strike drive wheel set 2, and cannot stop main click pin 86. On the other hand, strike uncoupling lever 55 is in its furthest position from strike drive wheel set 2, and consequently hinders both main pin 86 of main click 85 and repeater click pin 41, thus main click 85 and minute repeater release click 40 are hindered and cannot access detent ratchet 22. The minute repeater cannot be activated by the user. No striking function can therefore be activated. There is nothing to prevent mode selection lever 96 being moved into another position.

Figure 10:
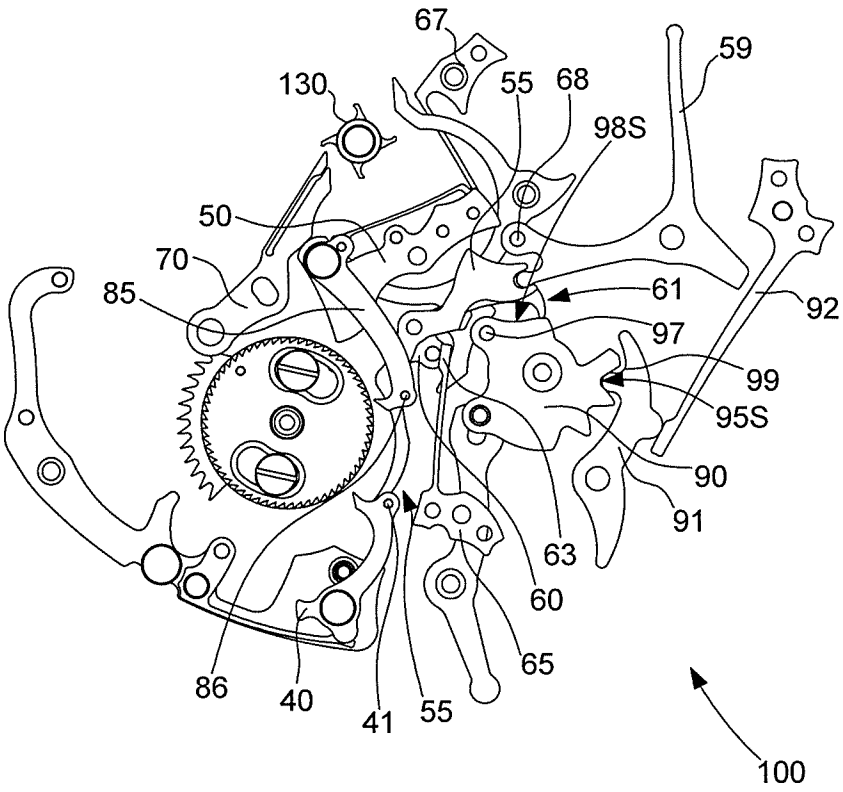
FIGS. 9 and 10 represent the striking mechanism according to the invention stopped in silent mode.
Figure 9:
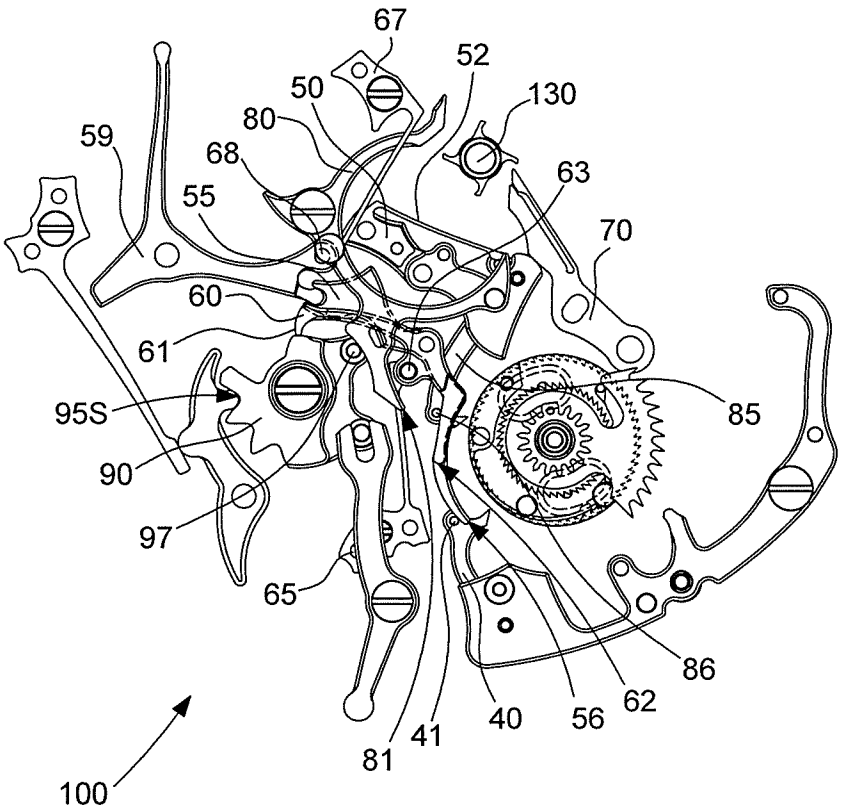
Figure 31:
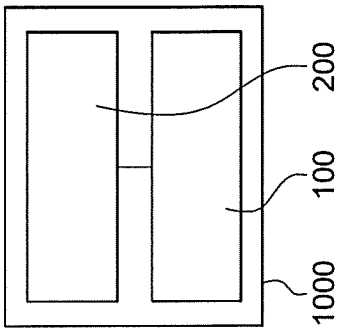
FIG. 31 is a block diagram which represents a watch comprising a striking mechanism according to the invention.
Figure 32:
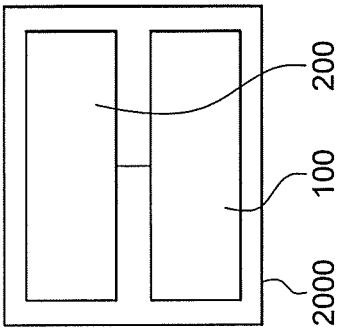
FIG. 32 is a block diagram which represents a musical timepiece comprising a striking mechanism according to the invention.
Figure 11:
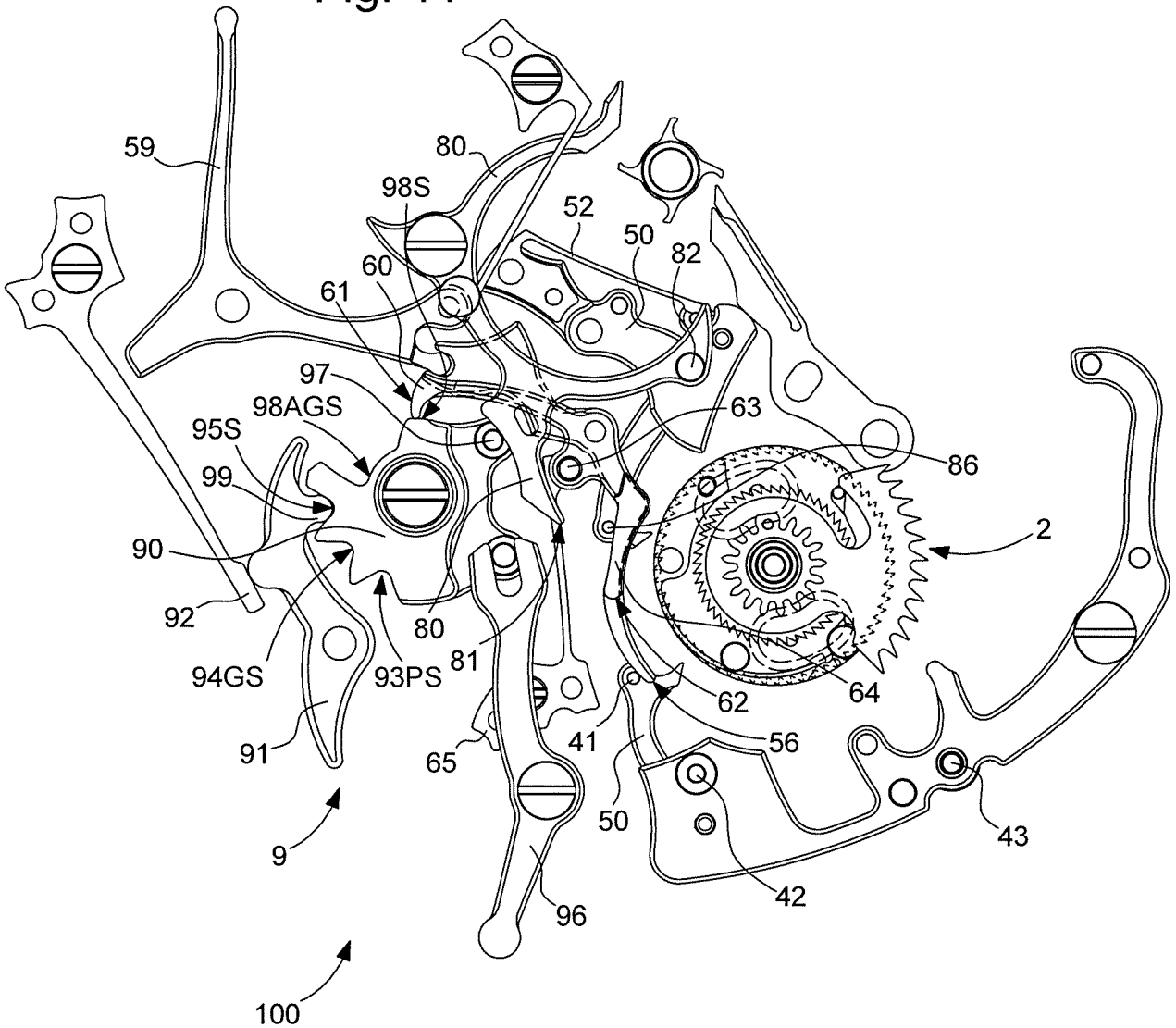
FIG. 11 is a detail of FIG. 9.
Figure 12:
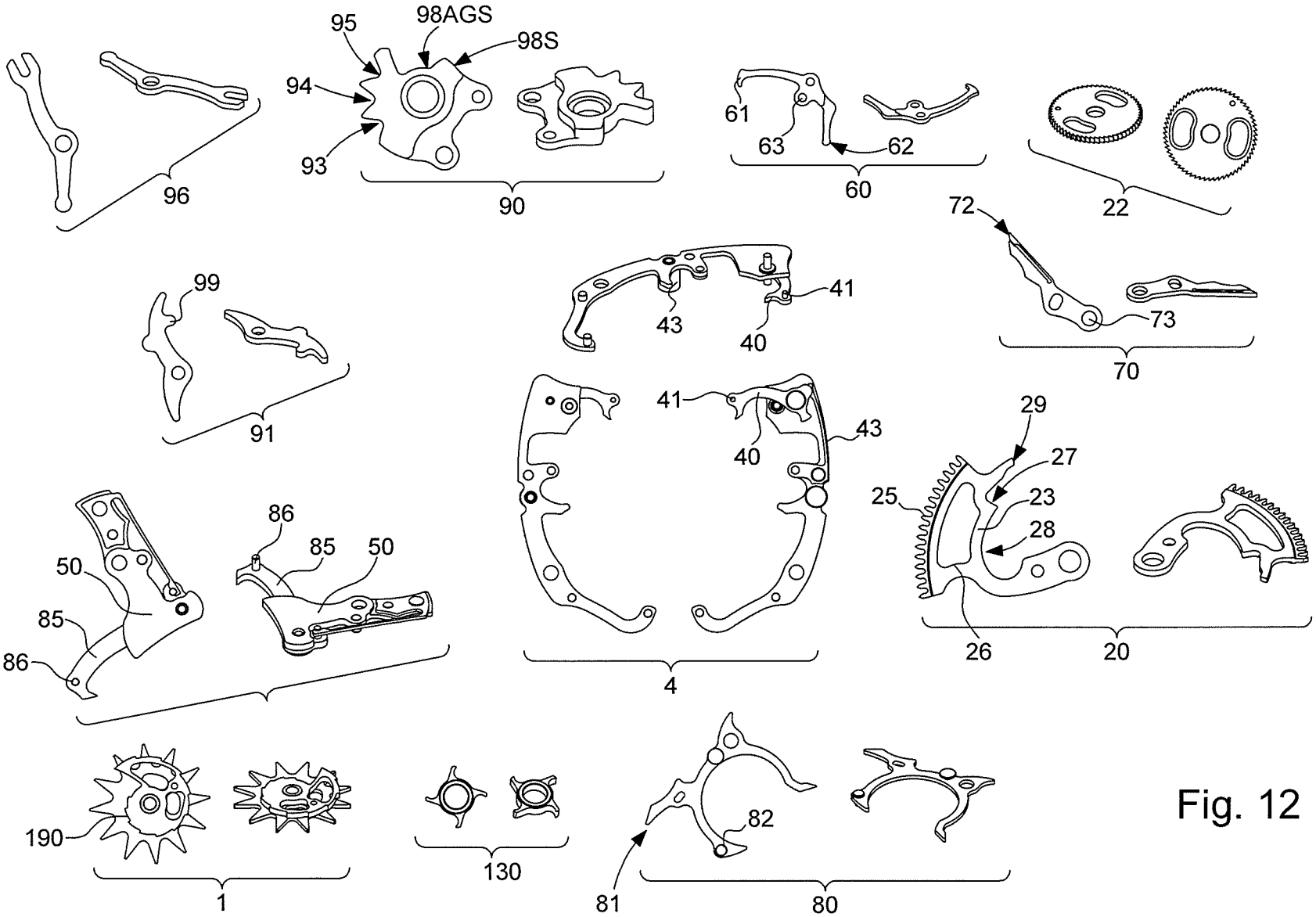
FIG. 12 is a schematic, plan view from both sides, of the panoply of main components of the striking mechanism according to the invention.
Figure 14:
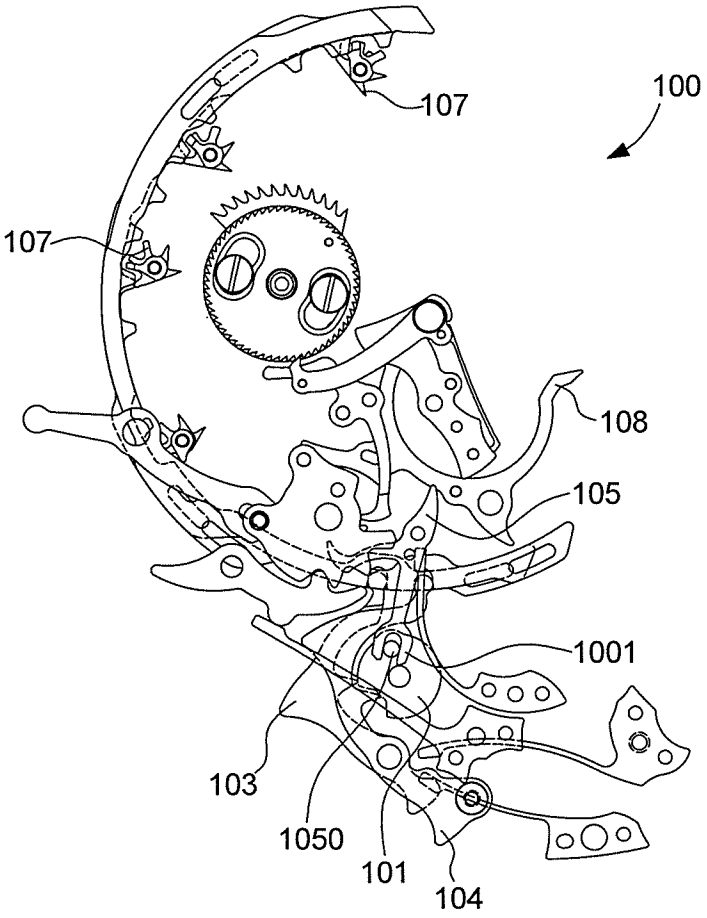
FIGS. 13 to 18 represent, in a similar manner to FIGS. 1 to 8, a first variant of the striking mechanism combining strike selection and mode selection according to the invention, allowing a first tune to be played in petite sonnerie mode, and a second tune, different from the first tune in grande sonnerie mode.
Figure 13:
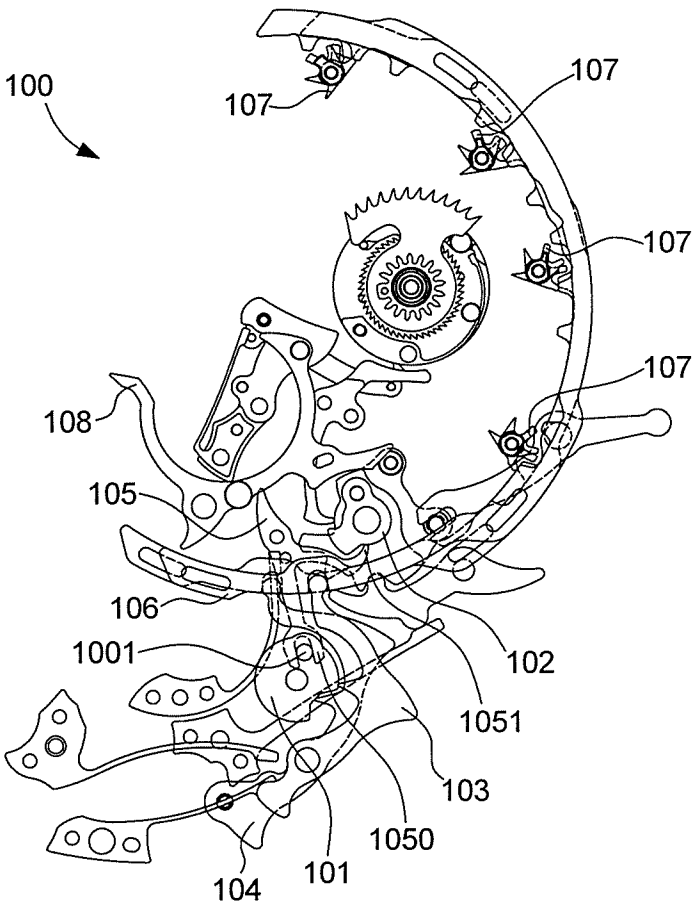
Figure 16:
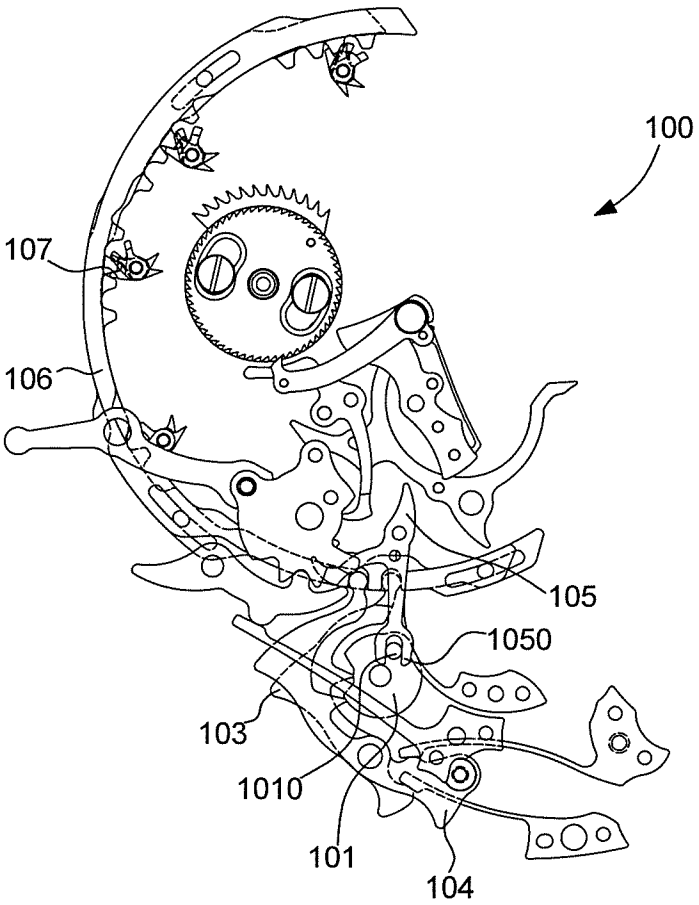
Figure 15:
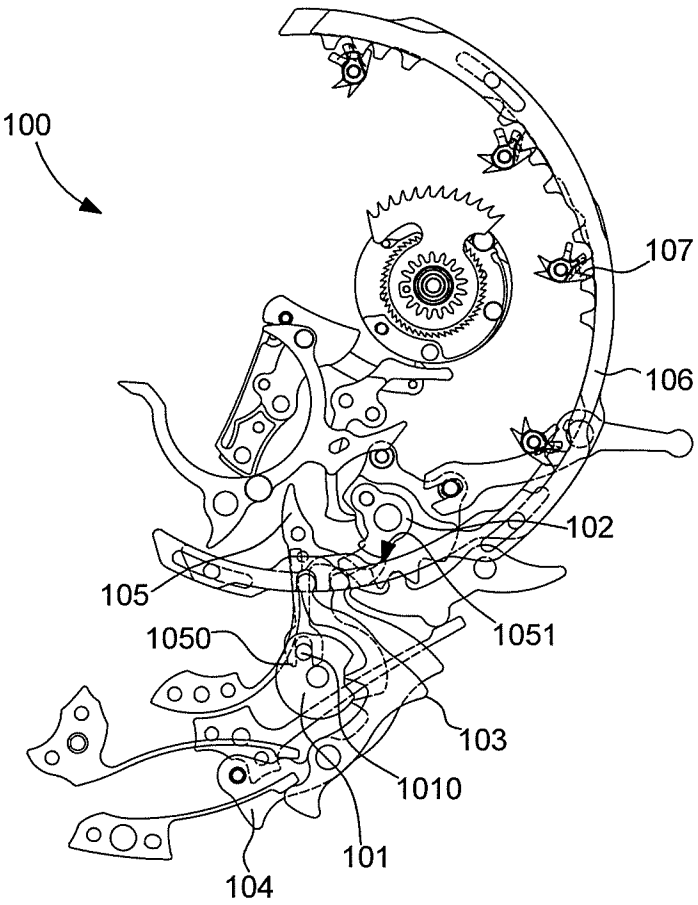
Figure 18:
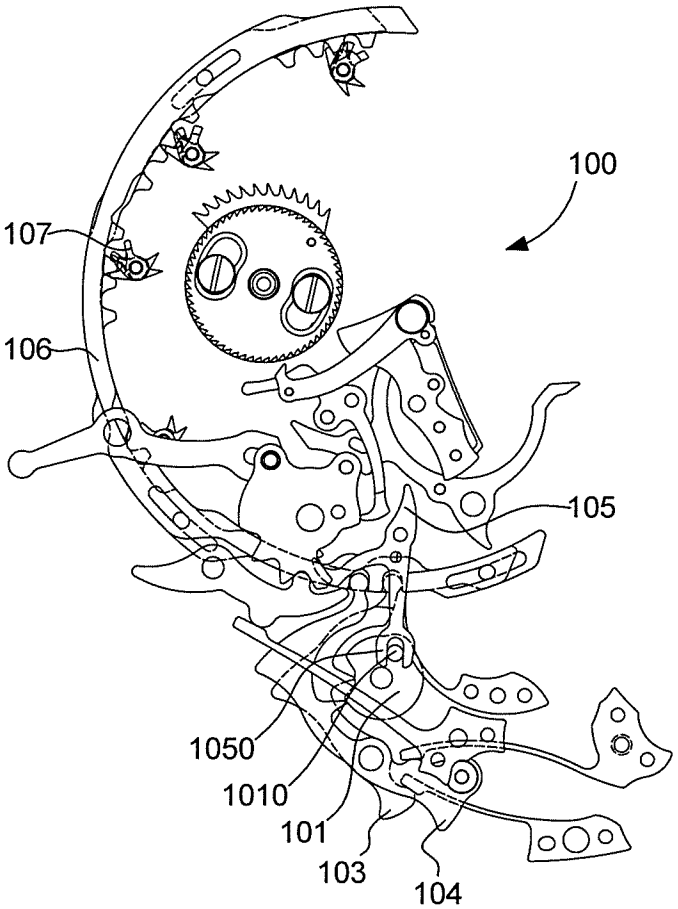

FIGS. 9 to 11 illustrate stoppage in silent mode and show mode selector 9 in the indexing position corresponding to silent mode notch 95S. These Figures show an operating bolt 59 for the articulated control of strike uncoupling lever 55. Reading beak 61 of silencing lever 60 is resting on the largest radius 98S of peripheral shoulder 98 of cam 90, and the main arm 64 of silencing lever 60 is in its furthest position from strike drive wheel set 2, and stops main click pin 86. Strike uncoupling lever 55 is also in its furthest position from strike drive wheel set 2, and hinders repeater click pin 41. Thus, main click 85 and minute repeater release click 40 are hindered and cannot access detent ratchet 22.

It is clear that the stopping mechanism is only active when there is not enough energy and that, otherwise, this stopping mechanism is disconnected.

FIGS. 13 to 19 illustrate a first variant of the striking mechanism combining strike selection and mode selection according to the invention, allowing a first tune to be played in petite sonnerie mode, and a second tune, different from the first tune in grande sonnerie mode.

FIGS. 20 to 29 illustrate a second variant of the striking mechanism combining strike selection and mode selection according to the invention, wherein one or the other allows the first tune or the second tune to be played, in each strike mode.

It is understood that the only limitation is that of available space inside the watch or the musical timepiece: these first and second variants are each presented here with two tunes, but it is understood that the striking mechanism could play more tunes. or differentiate between the tunes on different sets of gongs or chimes, in combination with the teachings of European Patent No. EP2947523B1 by the same Applicant, and European Patent Application Nos. EP15190808.4, EP15168700.1, EP15183110.4, and EP16206572.6 by the same Applicant, the details of which are not repeated here. Likewise, mode selection can be performed by coaxial cams and/or juxtaposed cams in one plane.

The invention is explained hereinafter in the particular case of a first tune and a second tune. It is evidently applicable to a higher number of tunes, or to the selection of particular sets of gongs instead of or in addition to tunes, according to the teachings of the aforementioned patent applications.

In a particular embodiment of the invention, striking mechanism 100 includes a tune selector cam 101 which is arranged to cooperate with at least a first tune lever 103 and a second tune lever 104, which are both arranged to cooperate with a tune selector 106 arranged to control different trips 107 for operating strike hammers. This first tune lever 103 and second tune lever 104 each include an intermediate feeler beak 1030, 1040, which is arranged to move over the periphery 1011 of tune selector cam 101. The latter includes a pin 1010 driving a fork 1050 of a tune selection feeler arm 105, a first finger 1051 of which follows the periphery 1021 of a tune-selection-by-mode cam 102, whose angular position is directly or indirectly controlled by mode selector 96, and including a second travel limiting finger 1052. Tune-selection-by-mode cam 102 is, more particularly, in the same plane as tune selector cam 101.

In the first embodiment, the petite sonnerie lever interacts with pin 97, as seen in FIGS. 1 to 11.

Figure 17:
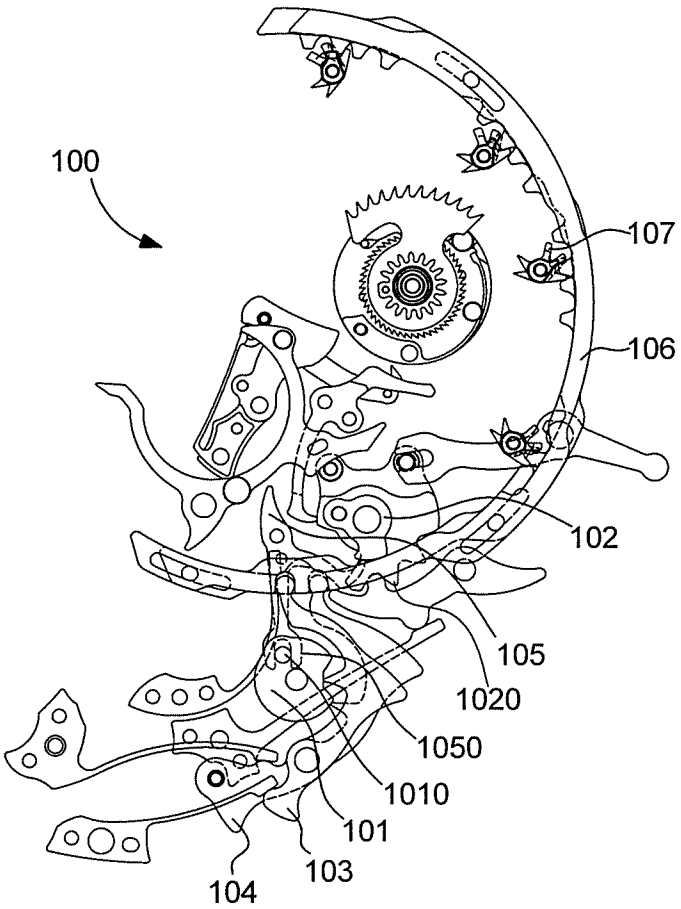
Figure 19:
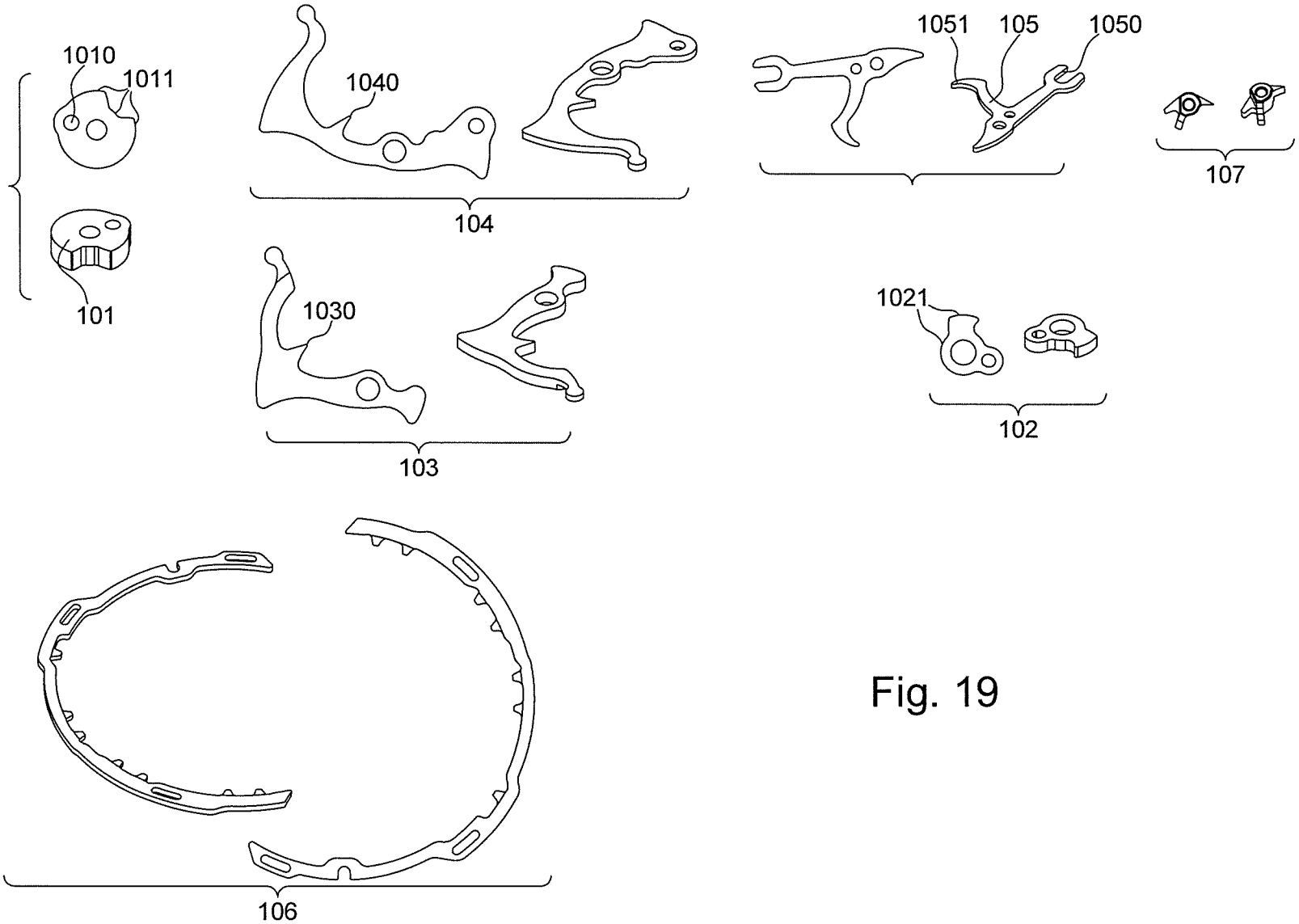
FIG. 19 is a schematic, plan view from both sides, of the panoply of main components of the striking mechanism of this first variant.
Figure 20:
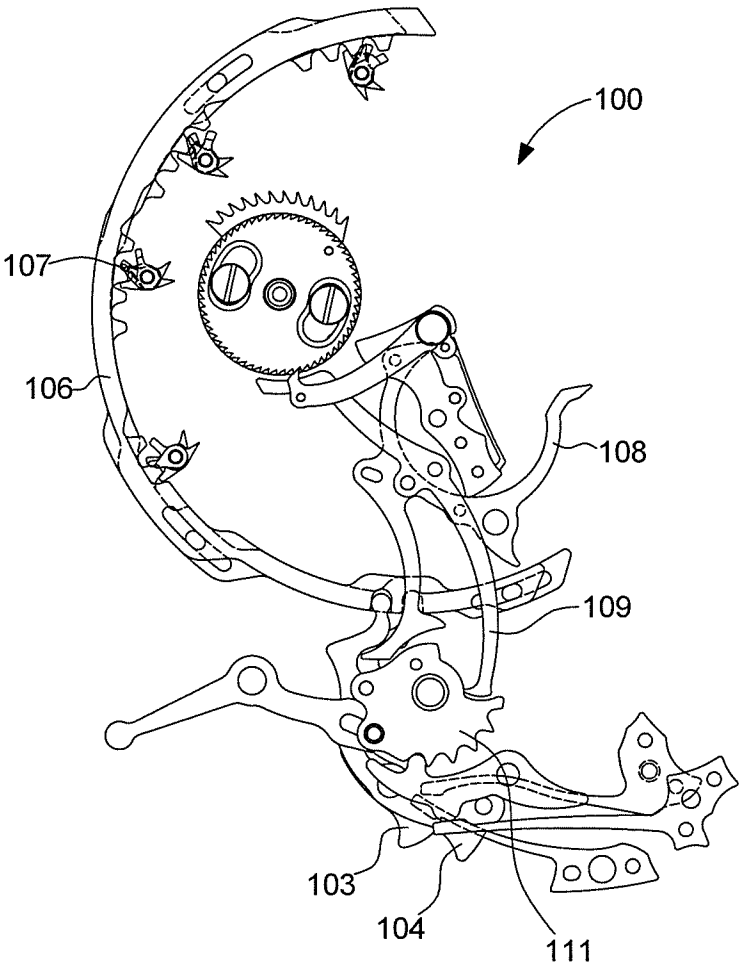
FIGS. 20 to 29 represent, in a similar manner to FIGS. 13 to 18, a second striking mechanism variant combining strike selection and mode selection according to the invention, wherein one or the other allows the first tune or the second tune to be played, in each strike mode.

More particularly, mode selector 96 is arranged to control the angular position of a notched sector 1020, seen in FIG. 17, which pivots integrally with tune-selection-by-mode cam 102, which notched sector 1020 is held in position by a jumper and/or a holding spring.

More particularly, mode selector mechanism 9 includes a single operating member, accessible to the user, forming mode selector 96 and arranged to also control said selection of a tune and/or a set of gongs.

Striking mechanism 100 according to the second variant includes, in a similar manner, at least a first tune lever 103, and a second tune lever 104, which are both arranged to cooperate with a tune selector 106 arranged to control different trips 107 for operating strike hammers, first tune lever 103 and second tune lever 104 each include an intermediate feeler beak 1030, 1040, which runs over the periphery respectively of a first cam 114 controlling the first tune and a second cam 115 controlling the second tune.

Figure 21:
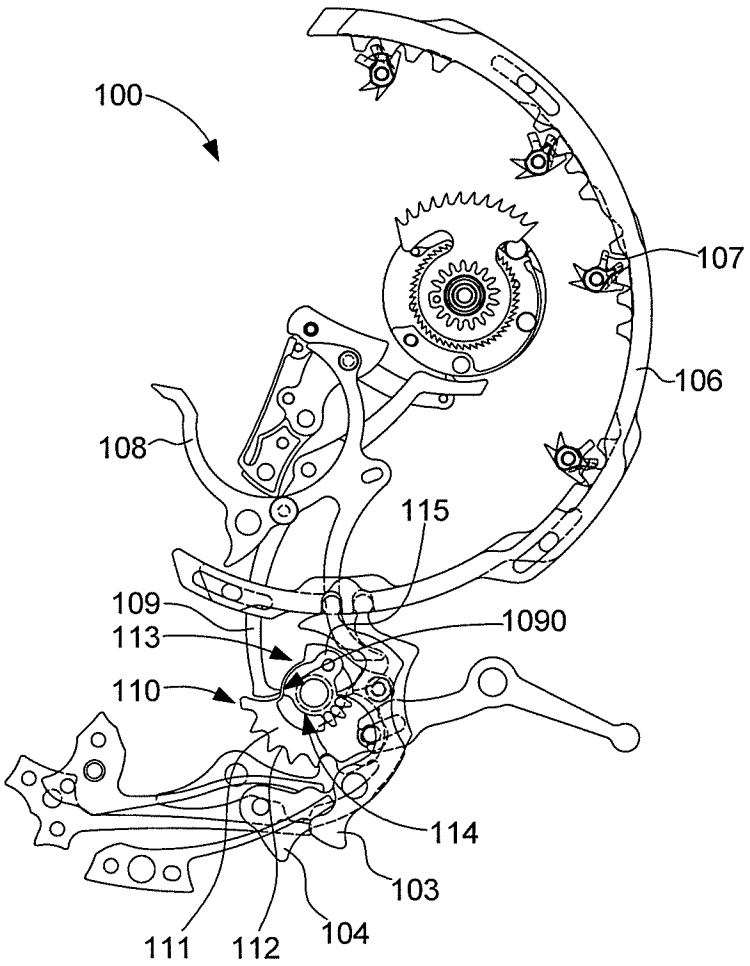
Figure 22:
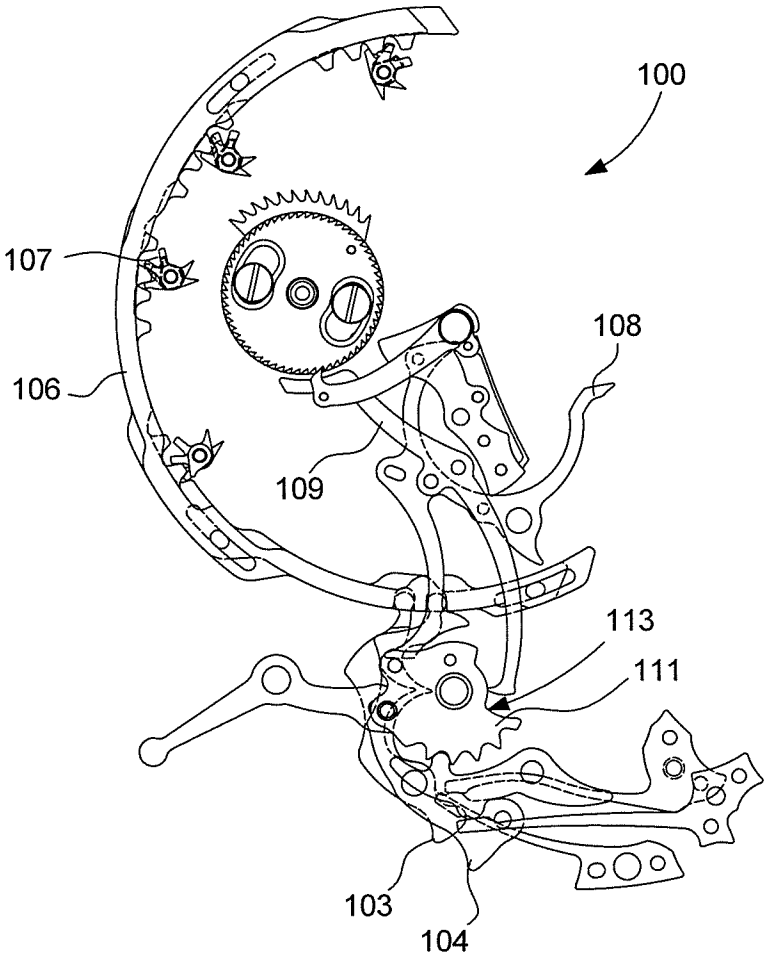
Figure 23:
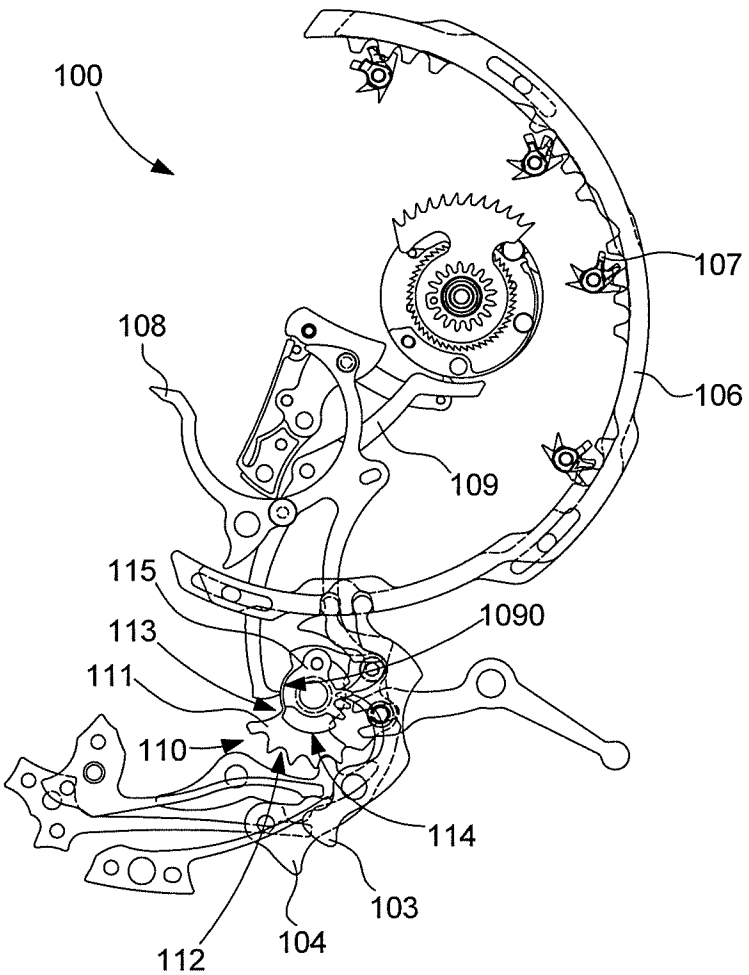
Figure 24:
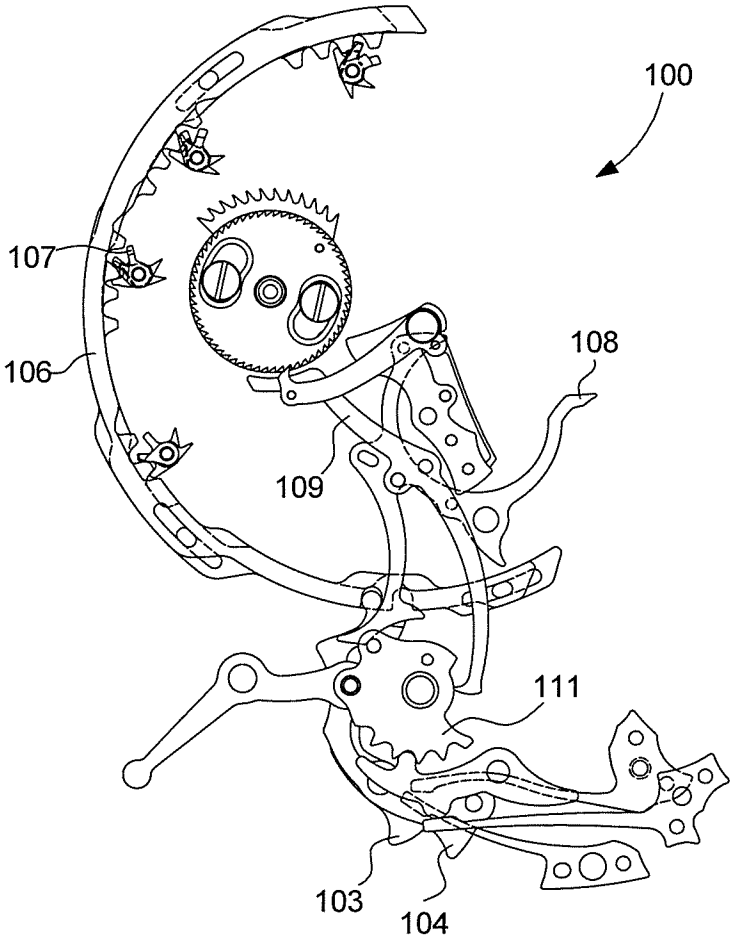
Figure 25:
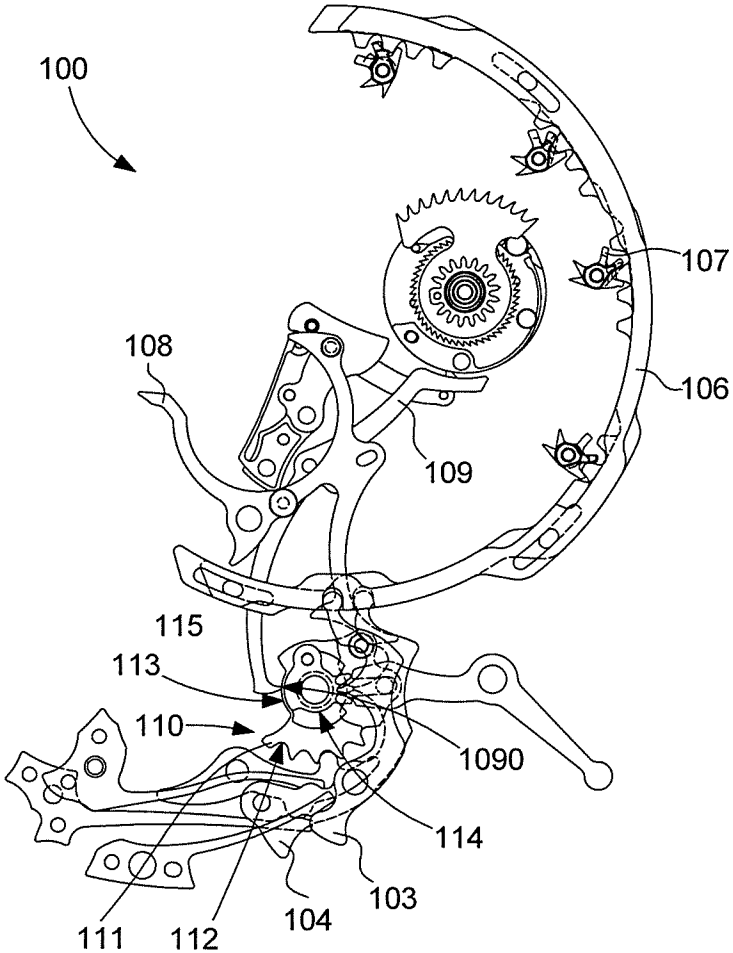
Figure 26:
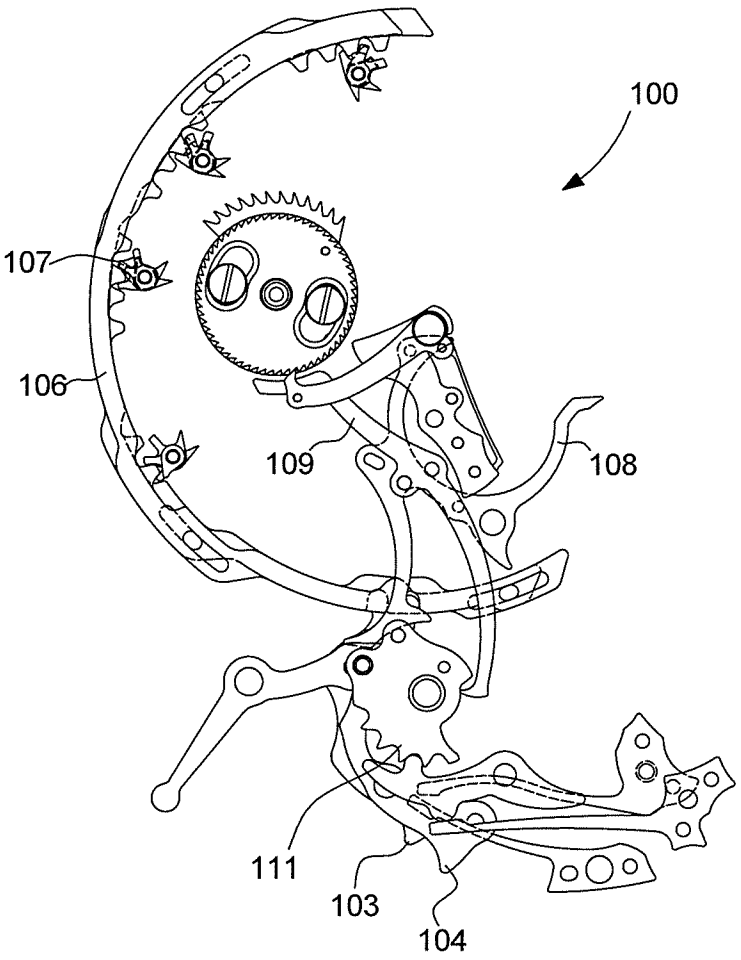
Figure 27:
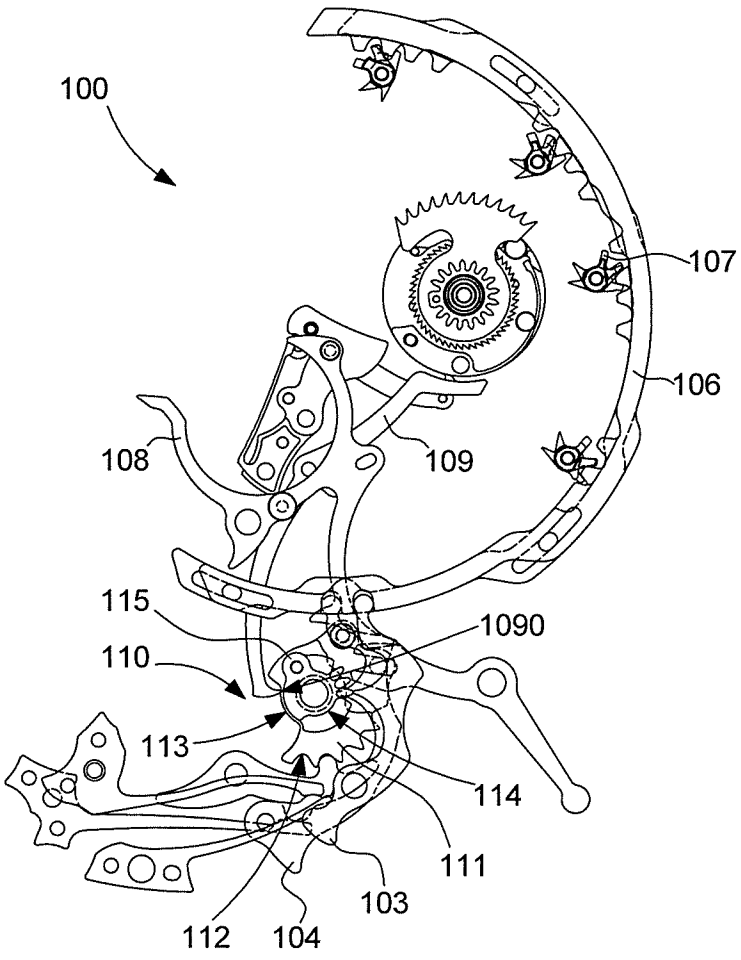
Figure 28:
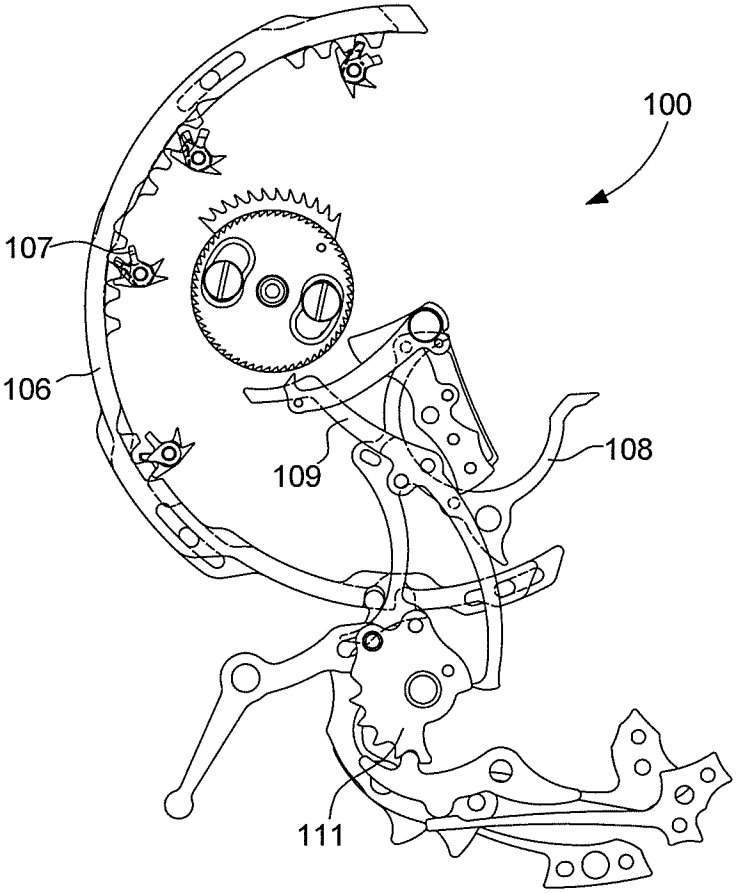
Figure 29:
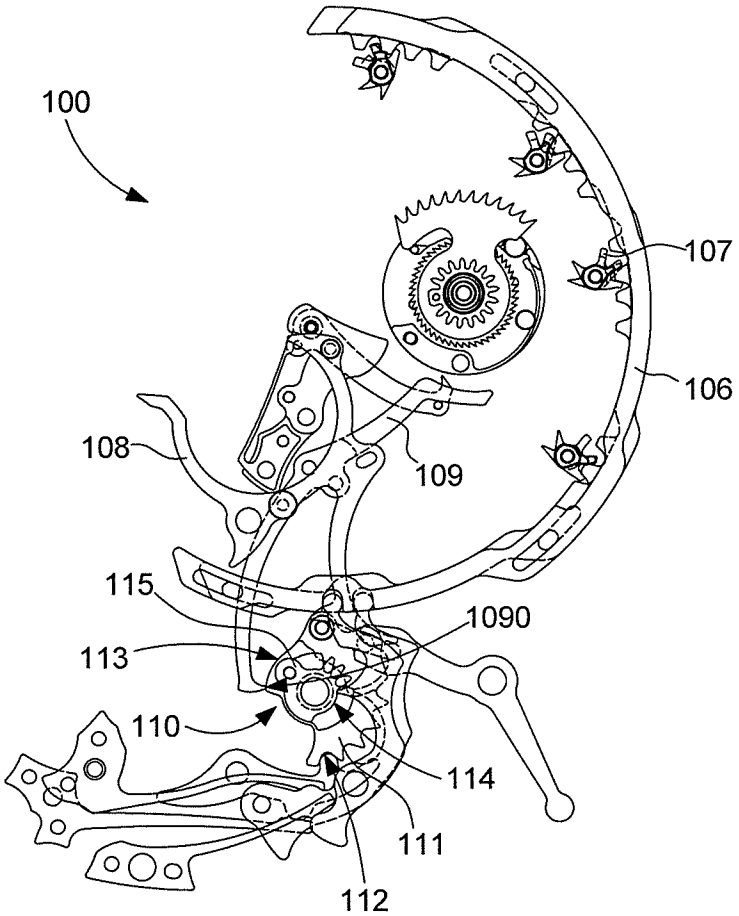
Figure 30:
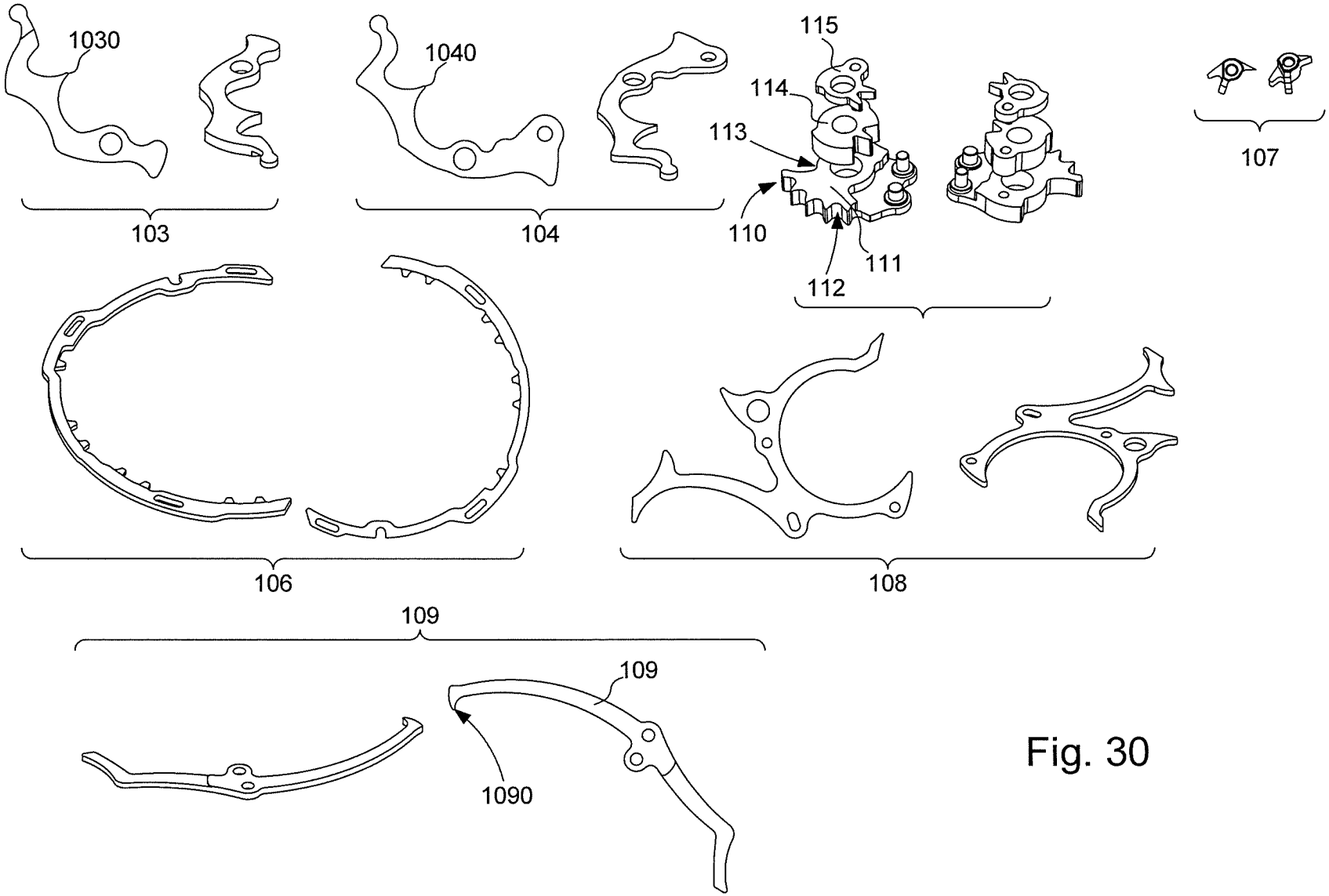
FIG. 30 is a schematic, plan view from both sides, of the panoply of main components of the striking mechanism of this second variant.

More particularly, mode and tune selection is controlled here by a control wheel set 110, which includes several cams stacked one on top of the other, wherein a first cam 111, 90, includes notches 112, 93 for the angular positioning and holding thereof by a jumper 116, 91, with a holding spring, seen in FIG. 21, and for controlling petite sonnerie, grande sonnerie and silent modes via its peripheral contour 113, which is followed by a beak 1090 comprised in a passing strike isolator 109, arranged to prevent any interference between a minute repeater function, when striking mechanism 100 includes a minute repeater mechanism, and a passing strike function.

More particularly, as represented in the Figures, at the lower level, a first cam 111 is similar to the cam 90 presented above, and includes jumper notches 112, and the petite sonnerie, grande sonnerie and silent modes are controlled by its peripheral contour 113, which is followed by a beak 1090 of a passing strike isolator 109, arranged to prevent any interference between a minute repeater function and a passing strike function.

This control wheel set 110 is extremely compact and uses less height space than strike wheel set 2.

According to the variant embodiment, mode selector mechanism 90 includes at least a first cam 90, 111, or a notched sector 1020 which may have as many specific positions as there are designated modes of the striking mechanism, or which has positions specific to only certain of said modes.

More particularly, first cam 90, 111, or notched sector 1020, includes notched portions 93, 94, 95, each corresponding to one of the selectable modes. More particularly still, these notched portions are notches of variable size, requiring increasing force in one of the two directions of operation. More particularly, one particular notch, at or close to the centre, is larger than the end notches, to ensure safety by preventing the user from inadvertently changing from one strike mode to another.

In a variant, mode selector mechanism 9 includes at least one tune cam 101, 114, 115, which is arranged to differentiate between the set of different tunes, and/or the set of different gongs.

More particular, mode selector mechanism 9 includes at least one said cam 90, 111 including multiple notches for differentiating between tunes and/or gongs assigned to each strike mode.

Advantageously, striking mechanism 100 is capable of operation in at least two distinct modes including a silent mode.

It is seen that these different variants use many common components, which reduces production costs which are always high for large complications.

The invention therefore provides the possibility of creating a wide variety of differentiated striking functions, either controlled by the watch or timepiece movement 200 for passing strikes, for example day/night, AM/PM, weekly non-working days, or otherwise, or controlled by a user as he sees fit.

The invention also concerns a watch 1000 comprising a movement 200 including an output 3 for releasing a passing strike function by the movement, this movement 200 being arranged to drive at least one reference wheel set 1, and watch 1000 includes at least one such striking mechanism 100.

The invention also concerns a timepiece 2000 comprising a movement 200 including an output 3 for releasing a passing strike function by the movement, this movement 200 being arranged to drive at least one reference wheel set 1, and watch 2000 includes at least one such striking mechanism 100.

What is claimed is:

1. A striking mechanism including a movement, said striking mechanism being capable of operation in at least two distinct passing strike modes and on at least two distinct sets of gongs, said striking mechanism including a mode selector mechanism combined with a mechanism for selecting a tune or set of gongs, said mode selector mechanism including a user-accessible mode selector allowing the user to choose which strike mode to use, and at least one means for selecting a tune or set of gongs controlled by said movement for a passing strike, and/or accessible to the user for the selection of a tune or of a set of gongs, for performing passing strike functions or for a minute repeater function, said striking mechanism including at least one said means for selecting a tune or set of gongs distinct from said mode selector, wherein said striking mechanism includes a tune selector cam, which is arranged to cooperate with at least a first tune lever and a second tune lever, which are both arranged to cooperate with a tune selector arranged to control different trips for operating strike hammers, said first tune lever and said second tune lever each including an intermediate feeler beak arranged to move over the periphery of said tune selector cam, which includes a pin driving a fork of a tune selection feeler arm, a first finger of which follows the periphery of a tune-selection-by-mode cam, whose angular position is directly or indirectly controlled by said mode selector, and a second finger of which is arranged to limit the travel of a petite sonnerie lever.

2. The striking mechanism according to claim 1, wherein said tune-selection-by-mode cam is coplanar with said tune selector cam.

3. The striking mechanism according to claim 1, wherein said mode selector is arranged to control the angular position of a notched sector that pivots integrally with said tune-selection-by-mode cam, which notched sector is held in position by a jumper and/or a holding spring.

4. The striking mechanism according to claim 1, wherein said mode selector mechanism includes a single operating member, accessible to the user, forming said mode selector and arranged to also control said selection of a striking function and/or a set of gongs.

5. The striking mechanism according to claim 4, wherein said first tune lever and said second tune lever are both arranged to cooperate with said tune selector arranged to control different trips for operating strike hammers, said first tune lever and said second tune lever each including an intermediate feeler beak moving over the periphery, respectively of a first cam controlling the first tune, and of a second cam controlling the second tune.

6. The striking mechanism according to claim 4, wherein control of mode and tune selection is achieved via a control wheel set, which includes several cams, stacked one on top of the other, a first cam of which includes notches for the angular positioning and holding thereof by a jumper with a holding spring, and for controlling petite sonnerie, grange sonnerie and silent modes, via its peripheral contour, which is followed by a beak comprised in a passing strike isolator, arranged to prevent any interference between the minute repeater function and a passing strike function.

7. The striking mechanism according to claim 1, wherein said mode selector mechanism includes at least a first cam or a notched sector, which can have as many specific positions as there are designated modes of the striking mechanism, or which has positions specific to only some of said modes.

8. The striking mechanism according to claim 7, wherein said first cam or said notched sector includes notched portions each corresponding to one of the selectable modes.

9. The striking mechanism according to claim 8, wherein said notched portions are notches of variable size, requiring increasing force in one of the two directions of operation.

10. The striking mechanism according to claim 9, wherein said notches include one center notch larger than end notches, so as to prevent changing from one strike mode to another.

11. The striking mechanism according to claim 1, wherein said mode selector mechanism includes at least one tune cam arranged to differentiate between different tunes and/or the set of gongs.

12. The striking mechanism according to claim 1, wherein said mode selector mechanism includes said tune-selection-by-mode cam including multiple notches for differentiating between tunes and/or gongs assigned to each strike mode.

13. The striking mechanism according to claim 1, wherein said striking mechanism is capable of operation in at least two distinct strike modes including a silent mode.

14. The striking mechanism according to claim 1, wherein said striking mechanism includes an hour snail driven by a movement, a strike wheel set including a detent ratchet and a repeating rack pinion, a pivoting hour-rack for reading the snail and driving the pinion, a click set in motion at each passing strike to drive the detent ratchet, with a mode selector mechanism for selection by the user of a particular strike mode, among distinct modes including a silent mode, defining the angular position of a cam having an external profiled surface, wherein, in silent mode, the largest radius pushes back a beak of a silencing lever, to orient the silencing lever into a position where a main arm of the silencing lever moves the click away from the ratchet in order to disable every passing strike function.

15. A watch comprising a movement including an output for releasing a passing strike function by the movement, said movement being arranged to drive at least one reference wheel set, and said watch including at least one said striking mechanism according to claim 1.

16. A timepiece comprising a movement including an output for releasing a passing strike function by the movement, said movement being arranged to drive at least one reference wheel set, and said timepiece including at least one said striking mechanism according to claim 1.

* * * * *